US006108614A

United States Patent [19]

Lincoln et al.

[11] Patent Number: 6,108,614

[45] Date of Patent: Aug. 22, 2000

[54] SYSTEM AND METHOD FOR SERIAL COMMUNICATION BETWEEN A CENTRAL UNIT AND A PLURALITY OF REMOTE UNITS

[75] Inventors: Larry A. Lincoln; Kent A. Fritz, both of Milpitas; Robert M. Russ, Jr., Los Altos Hills; Denis C. Ruffo, Sunnyvale, all of Calif.

[73] Assignee: Diablo Research Corporation, Sunnyvale, Calif.

[21] Appl. No.: 08/711,998

[22] Filed: May 14, 1996

Related U.S. Application Data

[63] Continuation of application No. 08/523,033, Sep. 1, 1995, abandoned, which is a continuation of application No. 08/007,203, Jan. 22, 1993, abandoned.

[51] Int. Cl.[7] ..... G08B 5/22; G06F 15/00

[52] U.S. Cl. ..... 702/183; 340/825.06; 714/4; 370/438

[58] Field of Search ..... 340/825.54, 825.12–825.15; 370/85.11, 85.8–85.1, 438, 447, 452; 702/183; 714/4; 701/20, 275, 277; 709/400, 825.05–825.08

[56] References Cited

U.S. PATENT DOCUMENTS

| | | | |
|---|---|---|---|
| T104,003 | 3/1984 | Hall et al. | 340/825.08 X |
| 3,865,181 | 2/1975 | Mori et al. | 165/22 |
| 4,271,470 | 6/1981 | Dlugos et al. | 364/466 |
| 4,515,306 | 5/1985 | Grant | 236/9 A |
| 4,568,934 | 2/1986 | Allgood | 340/870.02 |
| 4,679,192 | 7/1987 | Vanbrabant | 370/85 |
| 4,754,919 | 7/1988 | Otsuka et al. | 236/49 |
| 4,821,526 | 4/1989 | Otsuka et al. | 62/180 |
| 4,831,558 | 5/1989 | Shoup et al. | 364/550 |
| 4,858,141 | 8/1989 | Hart et al. | 364/483 |
| 4,924,404 | 5/1990 | Reinke, Jr. | 364/464.04 |
| 4,931,948 | 6/1990 | Parker et al. | 364/505 |
| 4,947,928 | 8/1990 | Parker et al. | 165/22 |
| 4,974,665 | 12/1990 | Zillner, Jr. | 165/21 |
| 4,991,123 | 2/1991 | Casamassima | 364/550 |
| 4,998,245 | 3/1991 | Tanaka et al. | 370/85.1 |
| 5,022,460 | 6/1991 | Brown | 165/12 |
| 5,071,065 | 12/1991 | Aalto et al. | 236/49.3 |
| 5,076,346 | 12/1991 | Otsuka | 165/22 |
| 5,088,645 | 2/1992 | Bell | 236/46 R |
| 5,179,524 | 1/1993 | Parker et al. | 364/505 |
| 5,268,666 | 12/1993 | Michel et al. | 340/310 R |
| 5,289,362 | 2/1994 | Liebl et al. | 364/140 |
| 5,347,515 | 9/1994 | Marino | 370/85.2 |

*Primary Examiner*—Kamini Shah
*Attorney, Agent, or Firm*—Dick & Harris

[57] ABSTRACT

A user-responsive system has a controller and a plurality of remotes. Each remote typically has a corresponding sensor and/or actuator. Applications for this system include, but are not limited to heating, ventilating, and air conditioning systems, lighting systems, security systems, energy management systems, home automation systems, and home entertainment systems.

21 Claims, 14 Drawing Sheets

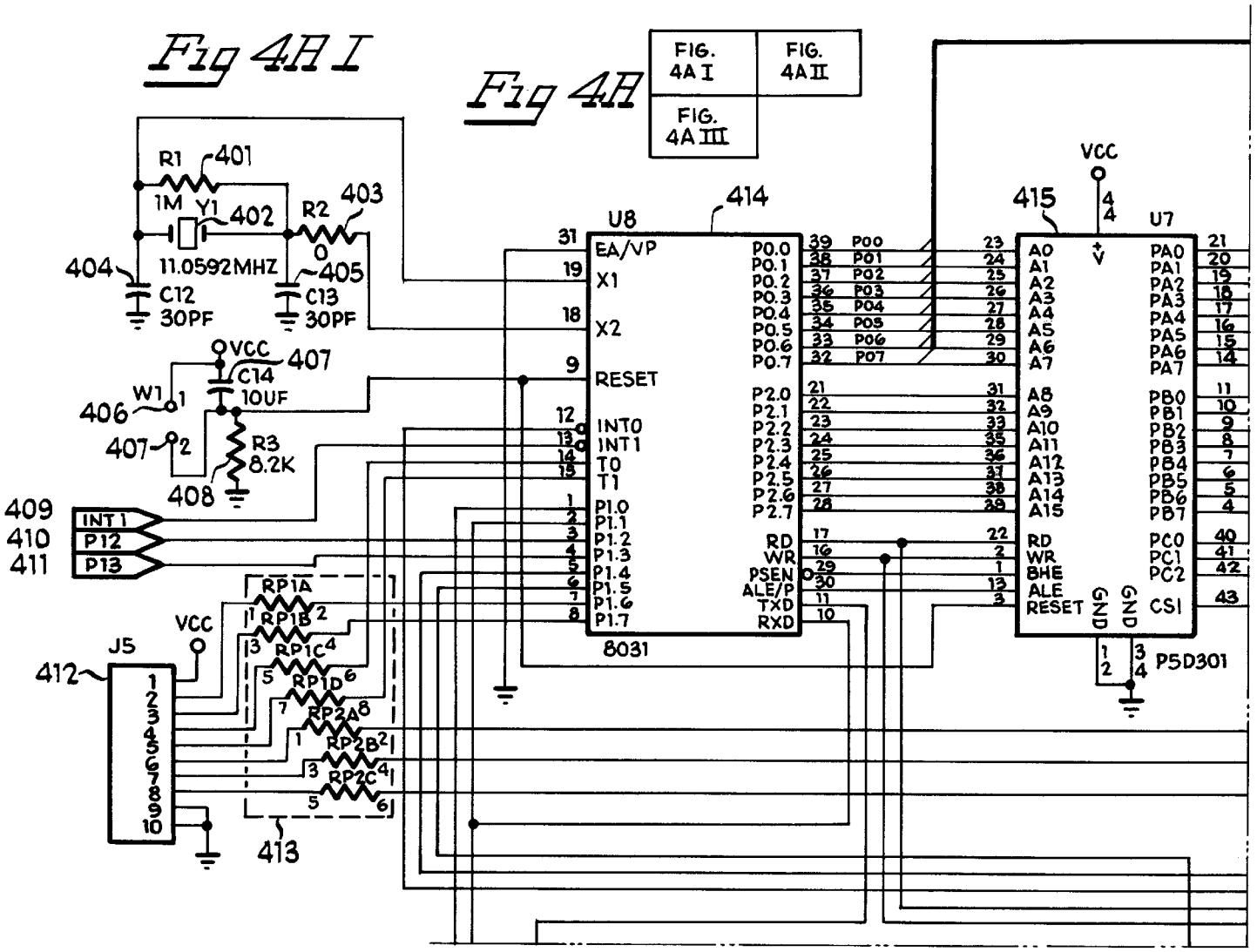
FIG. 4A I
FIG. 4A II
FIG. 4A III
U7
P5D301
U8
8031
VCC
GND
RESET
X1
X2
EA/VP
INT0
INT1
T0
T1
TXD
RXD
PSEN
ALE/P
RD
WR
BHE
ALE
CS1
R1
1M
R2
0
R3
8.2K
Y1
11.0592MHZ
C12
30PF
C13
30PF
C14
10UF
W1
J5
RP1A
RP1B
RP1C
RP1D
RP2A
RP2B
RP2C
INT1
P12
P13
401
402
403
404
405
406
407
408
409
410
411
412
413
414
415

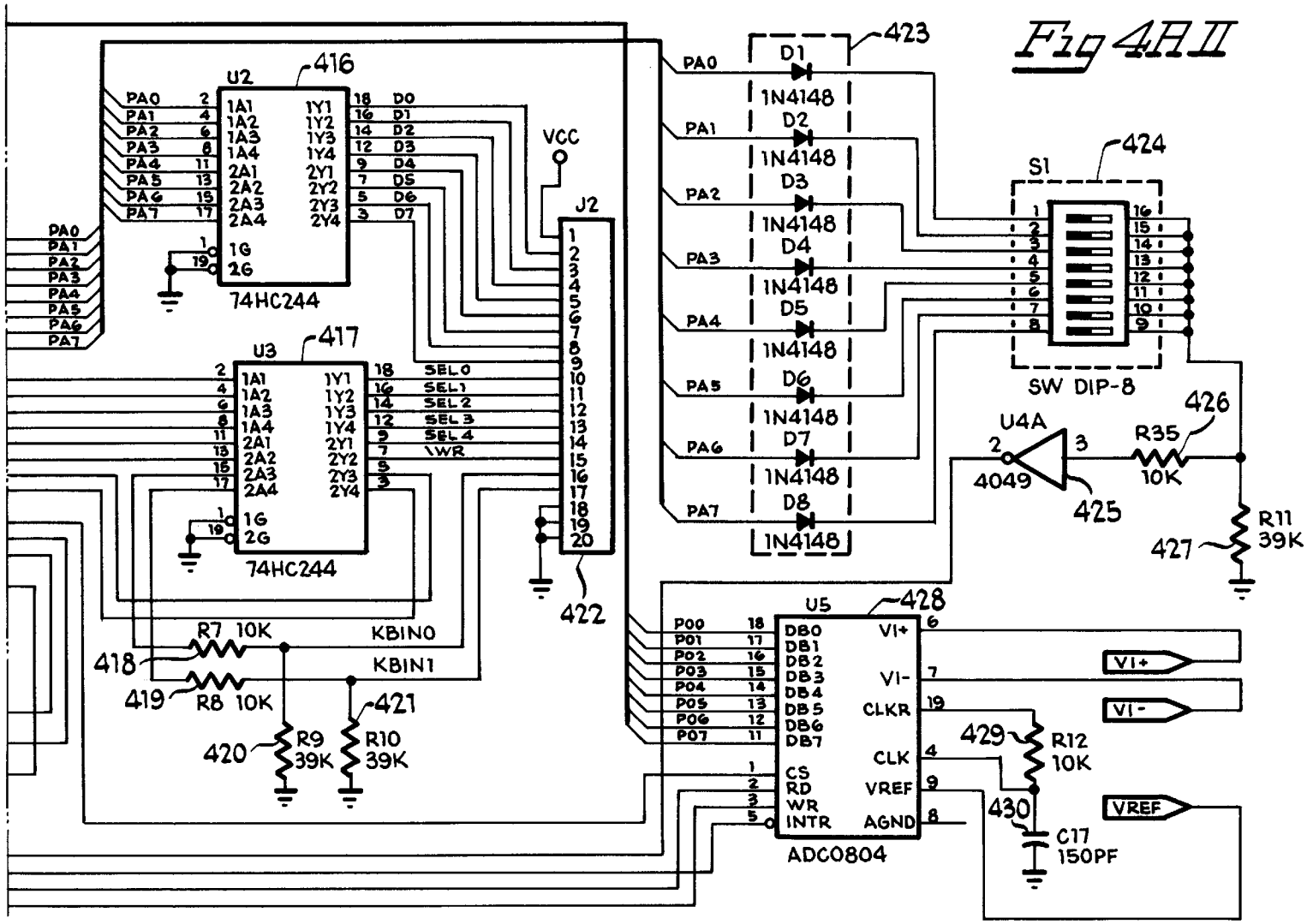
Fig 4A II
S1
SW DIP-8
424
R11 39K
427
426
R35 10K
425
U4A
4049
VI+
VI-
VREF
R12 10K
429
430
C17 150PF
428
U5
ADC0804
VI+
VI-
CLKR
CLK
VREF
AGND
DB0
DB1
DB2
DB3
DB4
DB5
DB6
DB7
CS
RD
WR
INTR
423
D1 1N4148
D2 1N4148
D3 1N4148
D4 1N4148
D5 1N4148
D6 1N4148
D7 1N4148
D8 1N4148
PA0
PA1
PA2
PA3
PA4
PA5
PA6
PA7
P00
P01
P02
P03
P04
P05
P06
P07
J2
422
VCC
D0
D1
D2
D3
D4
D5
D6
D7
SEL0
SEL1
SEL2
SEL3
SEL4
WR
KBIN0
KBIN1
416
U2
74HC244
417
U3
74HC244
421
R10 39K
R9 39K
420
R7 10K
R8 10K
418
419

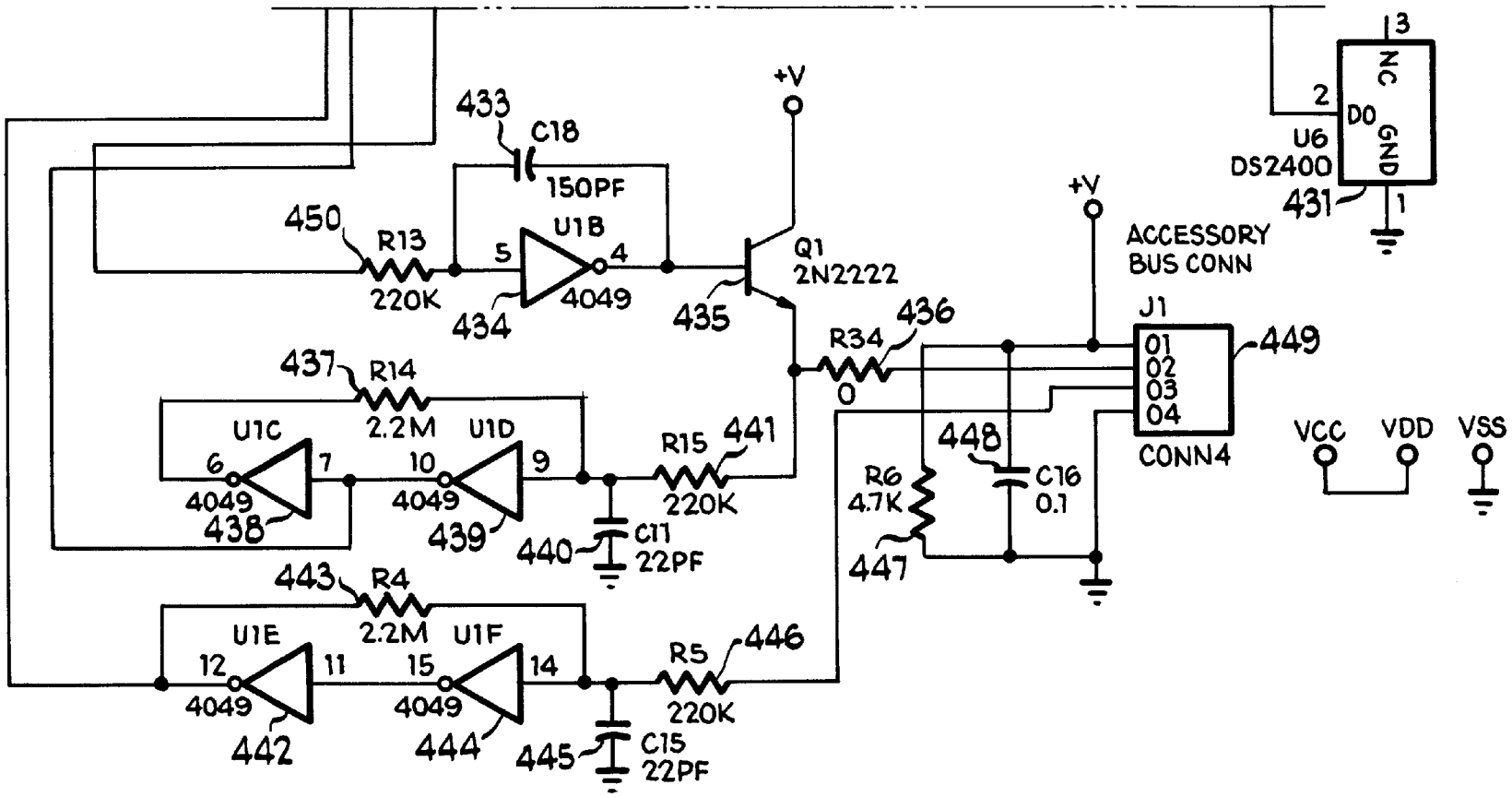
Fig 4H III

24VAC LINE
TO REMOTE 220
TO DAMPER
COPPER
TIN
HOT
1 YELLOW
CLOSE
2 GREEN
OPEN
3 RED
LIMIT
4 BLACK
702A
703A
704A
705A
702B
703B
704B
705B
5.1K
SOLID STATE RELAY
707
706
708
710
711
709

HOT
YELLOW
702B
214
715
716
MOTOR
713
712
719
718
714
717
LIMIT
RUN
N/O
N/C
CLOSE
GREEN
703B
OPEN
RED
704B
LIMIT
BLACK
705B
UNITY SYSTEMS DAMPER CIRCUIT

TO RS232 CABLE
J1
801
CONN 26
TXD
RXD
DTR
DSR
GTS
BTXD
RXD1
ATT 0
ATT 1
VCC
+V
R1
270
R2
10K
R4
10K
R10
270
R11
10K
R13
10K
U1A
1489
U2B
1488
U1B
1489
U2C
1488
U2A
1488
U3A
4049
U3B
4049
U3C
4049
U3D
4049
U3E
4049
6N135
1501
1502
1503
1504
800
802
803
804
805
806
807
808
808A
819
820
821
821A
822
823
824
834
835
836
837
838
839
840
851
852
853
854
855
856
867
868

Fig 9
| FLOW= | | O= | |
|---|---|---|---|
| | 0 | | 90 |
| | 10 | | 82 |
| | 20 | | 61.671 |
| | 30 | | 50.373 |
| | 40 | | 41.314 |
| | 50 | | 33.377 |
| | 60 | | 26.111 |
| | 70 | | 19.274 |
| | 80 | | 12.713 |
| | 90 | | 6.317 |
| | 100 | | 0.140 |
| | 900 | | 901 |
Fig 11
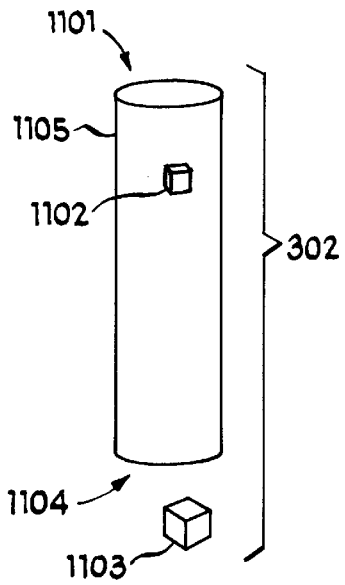
Fig 10
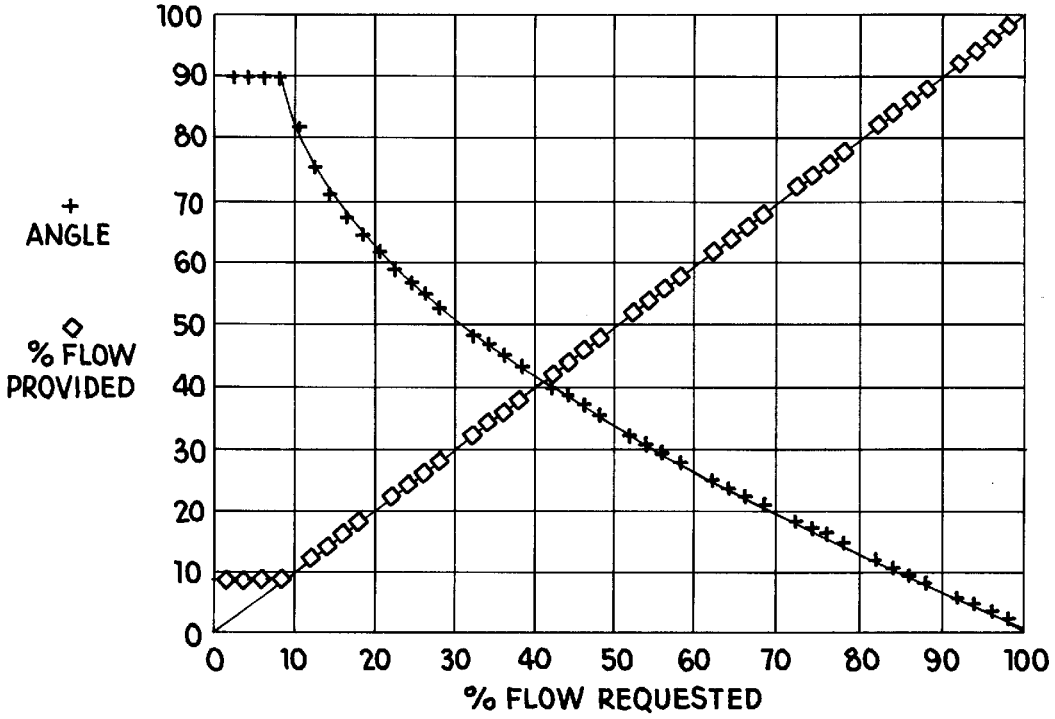

```
CALCULATING SUM:
        SUM 1 = SUM 2 = 0;
        FOR ( i = 0; i < PACKET LENGTH; i++)
            SUM 1 = (SUM 1 + (PACKET [i] & 15)) % 15;
            SUM 2 = (SUM 2 + SUM 1) % 15;
            SUM 1 = (SUM 1 + (PACKET [i] >> 4)) % 15;
            SUM 2 = (SUM 2 + SUM 1) % 15;

        CHECK SUM = (SUM 2 << 4) + SUM 1;

COMPLIMENTING SUM:
        CHECK 1 = 15 - ((SUM 1 + SUM 2) % 15);
        CHECK 2 = 15 - ((SUM 1 + CHECK 1) % 15);
        CHECK SUM = (CHECK 2 << 4) + CHECK 1;
```
Fig 15
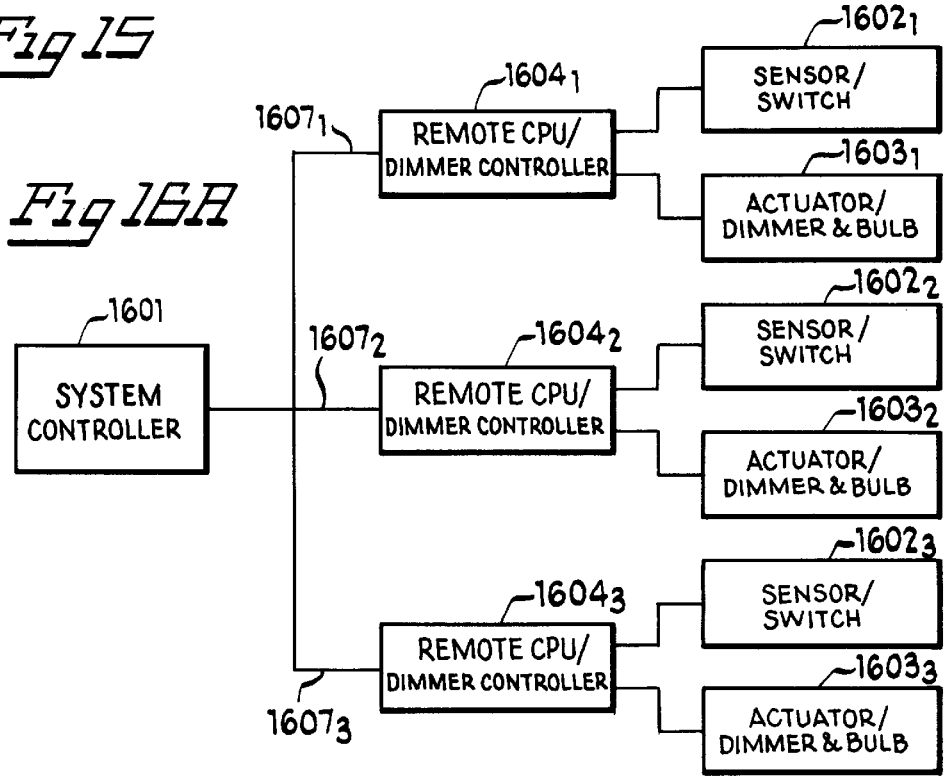
Fig 16A
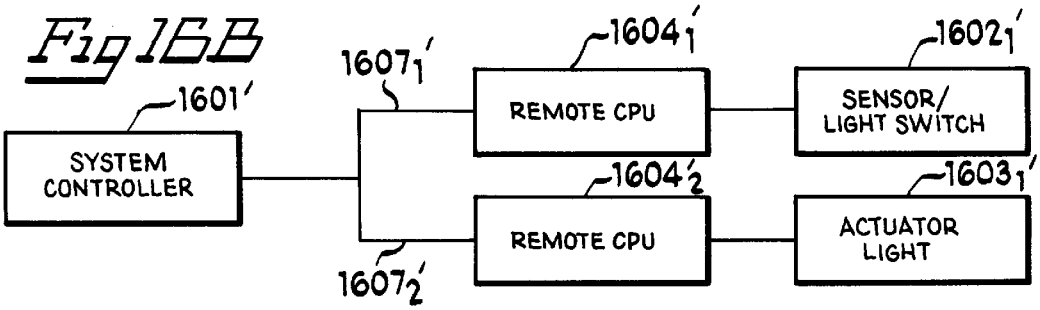
Fig 16B

SYSTEM AND METHOD FOR SERIAL COMMUNICATION BETWEEN A CENTRAL UNIT AND A PLURALITY OF REMOTE UNITS

This is a continuation of application Ser. No. 08/523,033, filed Sep. 1, 1995, now hereby abandoned, which is a continuation of Ser. No. 08/007,203, filed Jan. 22, 1993, abandoned.

CROSS REFERENCE TO MICROFICHE APPENDICES

The microfiche appendices include three appendices, i.e. Appendices A, B, and C, consisting of 4 sheets of microfiche and a total of 185 frames.

Appendix A, which is part of the present disclosure, is a microfiche appendix consisting of 1 sheet of microfiche having a total of 32 frames. Microfiche Appendix A provides a description of the internal operation of the controller simulator for the accessory bus, a description of the software modules that drive the accessory bus in the remote and the controller, and the accessory bus specification.

Appendix B, which is part of the present disclosure, is a microfiche appendix consisting of 2 sheets of microfiche having a total of 111 frames. Appendix B provides a copy of the source code used in accordance with the present invention for both the remote and the controller.

Appendix C, which is part of the present disclosure, is a microfiche appendix consisting of 1 sheet of microfiche having a total of 42 frames. Appendix C provides a description of the remote user interface firmware.

A portion of the disclosure of this patent document contains material which is subject to copyright protection. The copyright owner has no objection to the facsimile reproduction by anyone of the patent document or the patent disclosure, as it appears in the patent and Trademark Office patent files or records, but otherwise reserves all copyright rights whatsoever.

FIELD OF THE INVENTION

The present invention relates to an HVAC system, and in particular to a user-responsive HVAC SYSTEM.

BACKGROUND OF THE INVENTION

Heating, ventilating, and air conditioning (HVAC) systems are well known in the art. In a conventional HVAC system, one thermostat controls the air flow to multiple dampers located throughout the house. These dampers allow either air conditioned or heated air to flow into the rooms of the house. All dampers are manually set, and the heater/air conditioner is turned on and based on the set point of the thermostat and the actual temperature in the vicinity of the thermostat. However, typically, temperature conditions in the rooms in a house vary dramatically depending on which room has exposure to the sun, which room has a large window or a leaky seal, and which rooms, such as the kitchen, have appliances which generate additional heat. Thus, in a conventional HVAC system, the temperature conditions in the room having the thermostat approximate optimal conditions as determined by the user, while all other rooms in the home remain at less than optimal conditions.

Therefore, a need arises for an affordable HVAC system which allows for a user-desired temperature condition for each room in a house.

SUMMARY OF THE INVENTION

In accordance with the present invention, a user-responsive system is provided which includes a controller, at least one remote device (often called a "remote"), and a data bus. All remote device(s) receive information from and send information to the controller via the data bus. Specifically, each remote device receives a first and a second signal from the controller. The first signal triggers all the remote devices to pay attention to the second signal. The second signal identifies the particular remote device to which the controller wishes to send a third signal. After the particular remote device is identified, that remote device prepares to receive the third signal. All other remote devices, i.e. those not identified by the second signal, ignore the third signal. The third signal includes a command from the controller to the identified remote device to perform a predetermined activity. After the identified remote device performs the predetermined activity, the remote device confirms the status of the activity to the controller.

The present invention is implemented in any one or combination of systems having remote devices, each device typically having a corresponding sensor(s) and/or actuator (s). These types of systems include, but are not limited to heating, ventilating, and air conditioning systems, lighting systems, security systems, energy management systems, home automation systems, and home entertainment systems.

In accordance with the present invention, the user-responsive system conforms predetermined activity of the actuators with signals input by a user to the remote device. In this manner, the user-responsive system optimizes home conditions for user comfort, user convenience, user security, or user energy conservation.

In accordance with one embodiment of the present invention in an HVAC system, the sensor ensures accurate environmental detection by creating ambient air flow through a member having a first opening and a second opening. A heating element is positioned near the first opening while a temperature sensor is positioned near the second opening. As the heating element generates heat, the heated air rises out of the first opening, thereby drawing in ambient air into the second opening and through the member.

BRIEF DESCRIPTION OF THE DRAWINGS

FIG. 4A shows a partial circuit diagram of the sensor and actuator of FIG. 2.

FIG. 9 illustrates a table of illustrative flow rates and damper angles in accordance with the present invention.

FIG. 10 graphically shows the relationship between he steps of the damper and the resulting angle of the damper.

FIG. 11 illustrates a temperature sensor in accordance with the present invention.

FIG. 15 shows the C code for implementing a modified Fletcher checksum in accordance with the present invention.

FIG. 16A illustrates another embodiment of the present invention having a sensor which includes a light switch and an actuator which includes a light dimmer/bulb.

FIG. 16B shows another embodiment of the present invention having one remote CPU controlling a sensor and another remote CPU controlling an actuator.

DETAILED DESCRIPTION OF THE DRAWINGS

Figure 1:
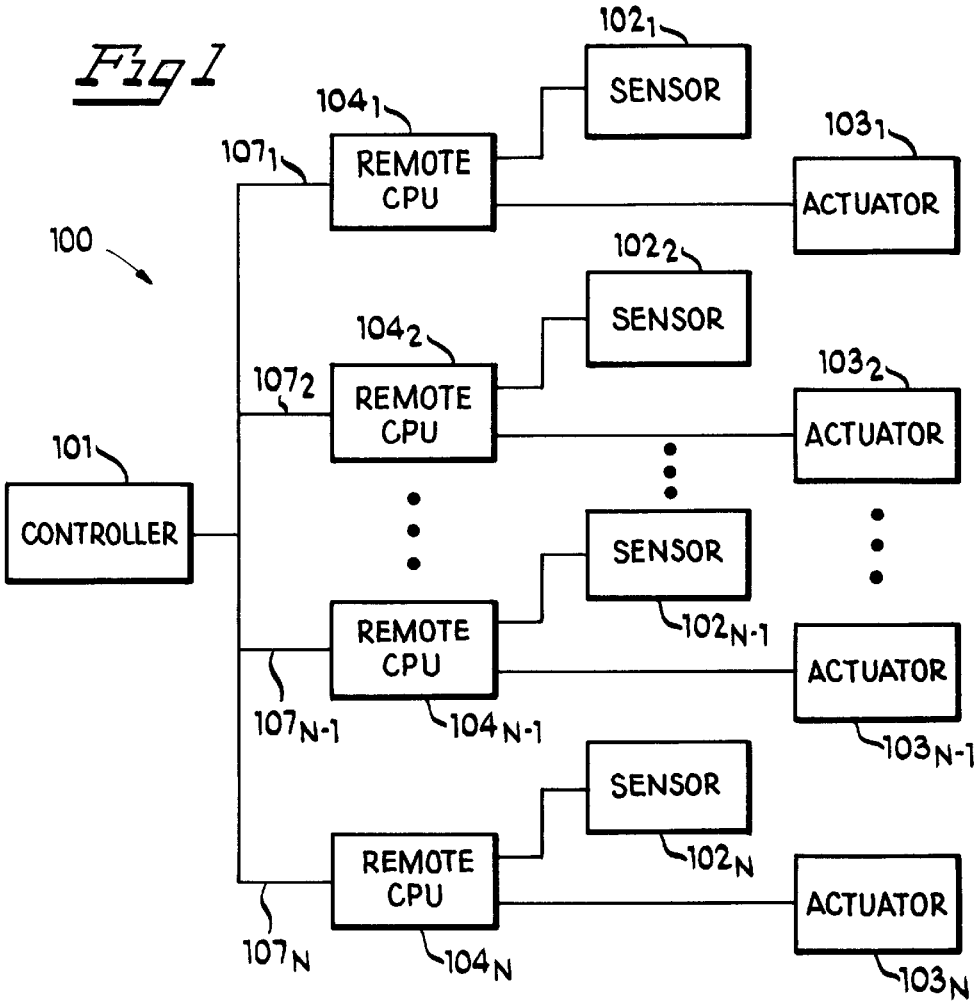
FIG. 1 illustrates a block diagram of a user-responsive system in accordance with the present invention having a plurality of remote devices.

In accordance with the present invention, a user-responsive system 100 illustrated in FIG. 1 includes a controller 101 coupled to a plurality of remote CPUs 104 via an accessory bus 107. Each remote CPU 104, has a corresponding sensor 102 and/or an actuator 103. Controller 101 sends commands and receives information from remote CPUs 104 on accessory bus 107. By selectively programming controller 101, a user has the ability to tailor the environment to conform to the user's lifestyle.

Figure 2:
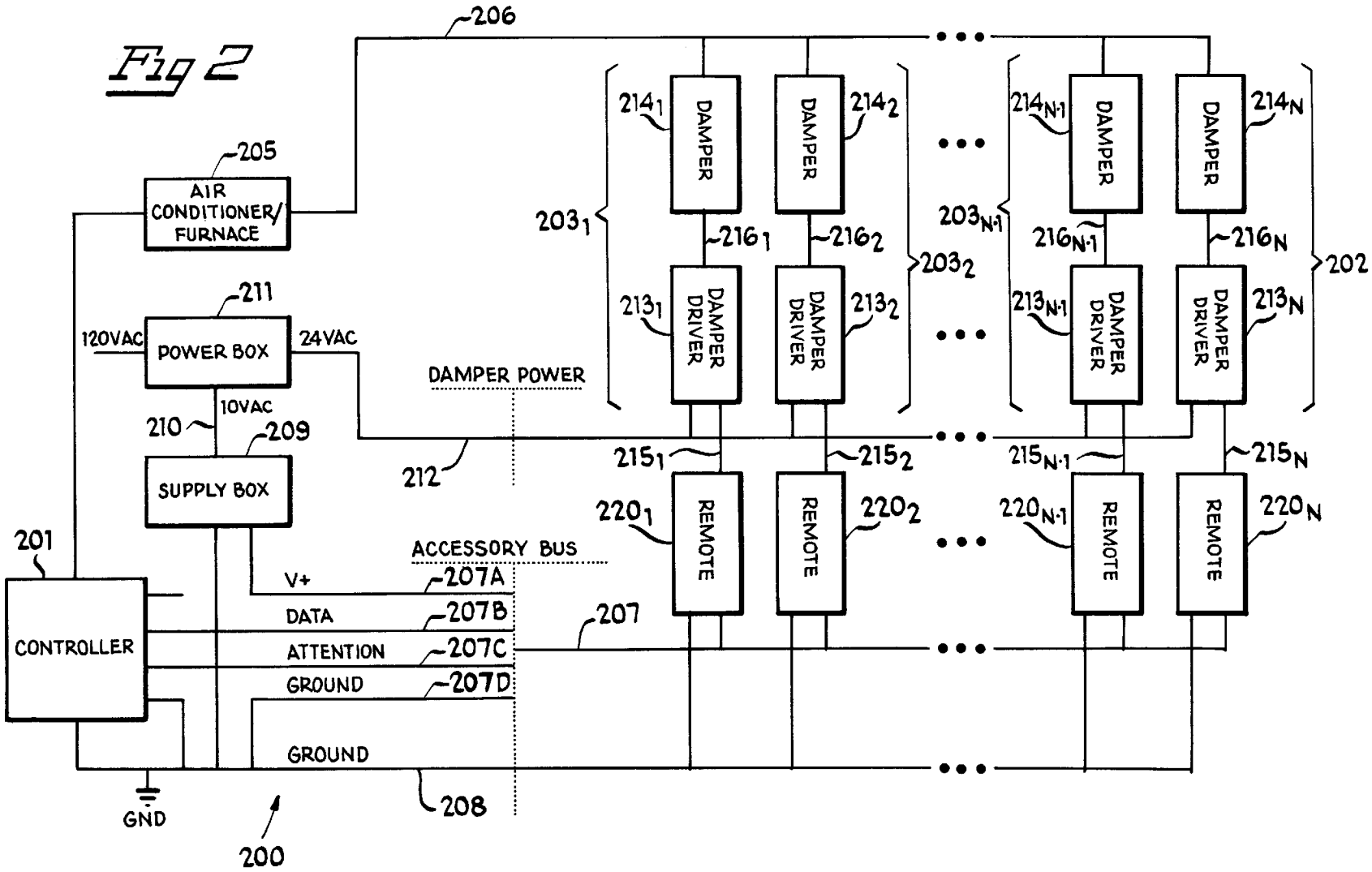
FIG. 2 shows a user-responsive HVAC system in accordance with the present invention.

In one embodiment of the present invention shown in FIG. 2, a user-responsive system 200 forms part of an HVAC system. Each remote 220 includes a remote CPU 304, a sensor 302, such as a temperature sensing means, and an interface 716 to actuator 203 (explained in detail in reference to FIG. 3). Each actuator 203 includes a damper driver 213 and a damper 214 which allows passage of hot/cool air from a furnace/air conditioner 205 via ducts 206.

Controller 201 controls furnace 205 and remotes 220. Controller 201 obtains environmental condition information, such as temperature, and user keypresses (explained in detail in reference to FIGS. 5 and 6) from remotes 220 via accessory bus 207.

In accordance with the present invention, the power to operate remotes 220 and actuators 203 is generated external to controller 201. Specifically, power box 211, having an input ac voltage of 120 volts, provides 24 vac to damper drivers 212 via line 212 (typically two stranded, 18 gauge wires) and provides 10 vac to supply box 209 via line 210 (typically 2 18 gauge wires). Supply box 209, in turn provides the voltage supply V+ (typically 12 vdc) on line 207A of accessory bus 207. Note that the heavy ground line 208, typically a stranded 12 gauge wire, keeps the reference voltage levels at remote devices 204 near 0.0 volts. However, if the current consumption is reduced at the remote, the supplemental heavy ground line 208 is not required.

Accessory bus 207 is coupled to each remote 220, for example, in a "daisy chain" configuration, or in a "star" configuration to reduce ground offset thereby improving the noise margins. Both the "daisy chain" and the "star" configurations are well known in the art and therefore are not described in detail.

Accessory bus 207 includes four wires: a voltage source V+ line 207A, a ground line 207D, a data line 207B, and an attention line 207C. Power to remote 220 is provided by the voltage source V+ line 207A and the ground line 207D. A current source to ground (not shown) is provided on both the data line 207B and the attention line 207C at controller 201. Signals on data line 207B are bidirectional. Thus, controller 201 and remotes 220 are capable of signalling using their own pull-up device and simultaneously sensing the data line 207B. Signals on attention line 207C are unidirectional, i.e. only provided by controller 201 to remotes 220. Accessory bus 207 is typically fabricated from telephone company specification cable consisting of two twisted pairs of 24 gauge wires.

If accessory bus 207 becomes so long, or so loaded with remote devices 204, or so exposed to noise, that accessory bus 207 cannot service the whole system area, a repeater may be required in +V line 207A, data line 207B, and Attention line 207C. Ground line 207D is used as a reference for the new Isolated Bus area. A new voltage supply or the old voltage supply filtered is used for V+ line 207A. Attention line 207C is then amplified. Data line 207B has the same pulldown current source and the same sense and drive circuits as the normal controller. This results in 3 lines: Data Into Controller, Data Out from Controller, and Data I/O to Remotes. The line to the Remotes will be functionally equivalent to data line 207B. The other two lines will need to be connected up to the Controller. When a Remote puts a "Break" on a Remote Data Line which is isolated from other Remote Data Lines in the system, the Controller must replicate this Break on all of the other Remote Data Lines.

Voltage source V+ line 207A and data line 207B are paired. In this manner, if data line 207B is pulled up to overcome the pulldown current source which is nominally 10 milliamps, voltage source V+ line 207A supplies the current. If data line 207B is driven by controller 201, only RC charging occurs because the pulldown current source is at controller 201. Attention line 207C and ground line 207D are also paired and function similarly to data line 207B and voltage source V+ line 207A, respectively. Note, however, that communication on attention line 207C is one way as mentioned previously.

Figure 12:
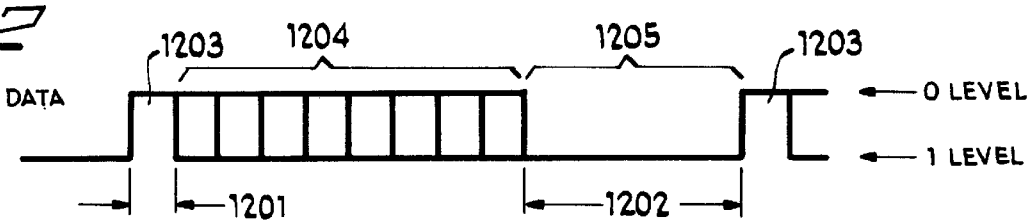
FIG. 12 shows a conventional, asynchronous byte format which is used in the present invention.

Referring to FIGS. 2 and 12, bytes on data line 207B and attention line 207C are sent using a conventional asynchronous byte format: i.e. one start bit 1203, eight data bits 1204, and between nine and eighty stop bits 1205.

TABLE 1

| Time | Min | Max |
|---|---|---|
| 1201 | 1 bit time | 1 bit time |
| 1202 | 9 bit times | 80 bit times |

Typical minimum and maximum times of periods 1201 and 1202 are shown above in Table 1. Note that the basic bit time is approximately 104 $\mu$s. This format is inverted from the output signal of a standard UART which is conventional for the industry. Thus, a high level on data line 207B (FIG. 2) represents a 0 and a low level represents a 1.

The extra Stop Bit time indicated in FIG. 12 and Table 1 is necessary for implementing the below-described protocol with a 4 bit microprocessor. For faster devices, the minimum Stop Bit time need not be enforced after the address byte (explained in detail below) of the message. Each sensor 202 on accessory bus 207 must check the Stop Bit in the first bit time after the last data bit when receiving or transmitting. If any stop bit is the wrong value, the entire message is invalid and must be retried later. Bits are spaced onto accessory bus 207 as if from a 9600 baud UART, whereas the bytes are spaced onto accessory 207 as if sent to a UART transmitting at 4800 baud. In this manner, the present invention ensures under 50% utilization of the bandwidth of accessory bus 207. Moreover, the above-described configuration provides the advantage that a simple microprocessor even without a UART in remote 220 accepts bits at a rate which is "fast" for the microprocessor, and then processes the bits during the gap between the bytes. Thus, the present system is compatible with low cost microprocessors running at a slow, i.e. 32, 768 Hz, or 455 Khz, clock rate.

Figure 13:
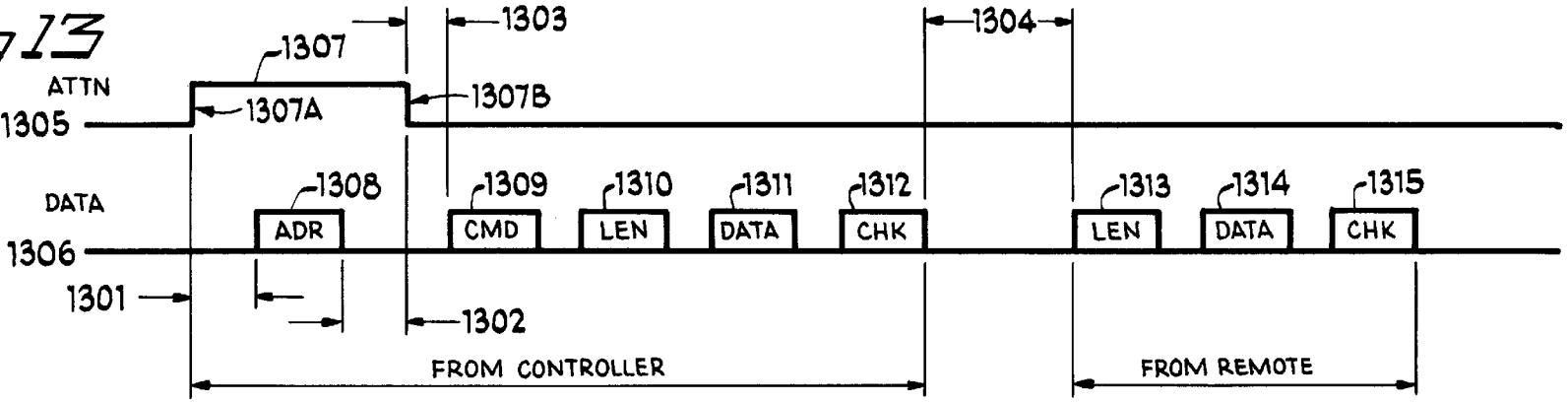
FIG. 13 illustrates signals on the attention line and the data line in accordance with the present invention.

As shown in FIG. 13, a typical message from controller 201 to a remote 220 consists of several fields of bytes, followed by a response from remote 220. These fields include: the address field, the command field, the length field, the data field, and the checksum field. Referring to FIG. 13, the Address field 1308 (single byte) is preceded by a low to high level transition 1307A on Attention line 1305 (line 207C in FIG. 2) to signal all remotes 220 on accessory bus 207 that a new message is being sent by controller 201. Attention line 1305 is released after Address field 1308 is completed and before the start bit of the Command field 1309.

TABLE 2

| Period | Min | Max |
|---|---|---|
| 1301 | 2 bit times | 4 bit times |
| 1302 | 3 bit times | 6 bit times |
| 1303 | 1 bit time | 80 bit times |
| 1304 | 9 bit times | 500 bit times |

Typical minimum and maximum times of periods 1301–1304 (FIG. 13) are shown above in Table 2. One bit time is approximately 104 $\mu$s.

This timing scheme allows a remote 220 to identify Address field 1308 by 4 different methods:

1. Remote 220 is alerted by the leading edge 1307A of the Attention pulse that an Address field 1308 is about to be transmitted. This method is typically used on 4-bit microprocessors;
2. Remote 220 is alerted by the start bit 1203 (FIG. 12) of the field and checks the level of Attention line 1305; or
3. Remote 220 is alerted on the reception of a byte and checks the level of Attention line 1305 to determine if an Address field 1308 is present.
4. Remote 220 is alerted on trailing edge 1307B of attention line indicating the last byte received by the UART is an address field 1308. Other bytes may be ignored if the address fails to match. This method is typically used when a UART is available.

After receiving Address field 1308, any remote 220 with an address that does not match this transmitted byte ignores Data line 1306 until the next Attention signal. In this manner, the efficiency of the CPU of remote 220 is significantly increased by providing "big" blocks of time for use by the CPU for other functions such as sensor or actuator control and for easier multitasking between communication and control. Furthermore, this method allows for the time between bytes to be shortened on faster devices, thereby increasing the throughput.

The command field 1309 (single byte) indicates the process to be executed by remote device 204. The length field 1310 contains the number of bytes to follow in the message. In the case of a message with no data field 1311, the number in the length field 1310 is one. Data field 1311 contains any number of bytes from zero up to 254. The length of data field 1311 is the above length minus one.

The checksum field 1312 is a modified Fletcher checksum. A conventional checksum is a value which is the arithmetic sum of all the bytes in the message. In this conventional system, as a processor reads the message, the processor also computes the sum of all the bytes in the message. If the two values are equal, the processor assumes that the message was received without error. A modified Fletcher checksum adds in an intermediate checksum in addition to each nibble (i.e. a sequence of 4 bits acted upon as a unit) of the message. The checksum field 1312 (single byte) is computed by splitting the address, command, length and data fields into nibbles, performing a modified Fletcher checksum, and taking the "complement" of the result. Note that longer or otherwise simpler or more robust data validation schemes, such as cyclic redundancy checks and checksums, are used in other embodiments of the present invention.

FIG. 15 shows the C code for implementing the modified Fletcher's checksum for using 4 bit data, resulting in an 8 bit checksum. Two 4 bit sums, sum 1 and sum 2, are stored. For each nibble in the packet, the nibble is added to sum 1 modulo 15, and then sum 1 is added to sum 2 modulo 15. Since the data is transmitted and interpreted as bytes, an order is important in the sum, the least significant nibble of a byte will be included in the sum first, then the most significant nibble. Because the sum is complemented, a modified Fletcher summation of the entire packet with the complement appended gives 0 for both sums. In other words, when remote 220 receives the message from controller 201, the resultant modified Fletcher sum of the entire message is zero.

After remote 220 has validated the Checksum field, remote 220 responds to controller 201. Controller 201 and remote 220 sample data line 1306 sometime during the period 1304 before the response (fields 1313, 1314 and 1315) to detect another remote device trying to break in during this pause. Note that controller 201 and remote 220 sample data line 1306 during every stop bit period 1205 (FIG. 12) to ensure no framing error has occurred.

The response message, like the controller message, contains a number of fields including: the length field, the data field, and the checksum field. The length field 1313 contains the number of bytes to follow in the data field 1314 and the checksum field 1315. If the response has no data field, the number in the length field is one. The data field 1314 contains any number of bytes, from zero up to 254n. The length of data field 1314 is the value in length field 1313 minus the length of the checksum field 1315.

The checksum field 1315 of the response message is slightly different than checksum field 1312 of the controller message. Although no address field is included in the response, the address of remote device 204 is included in the calculation of checksum field 1315 as the first byte. The 8-bit checksum field is computed in the method described in reference to FIG. 15.

Figure 14:
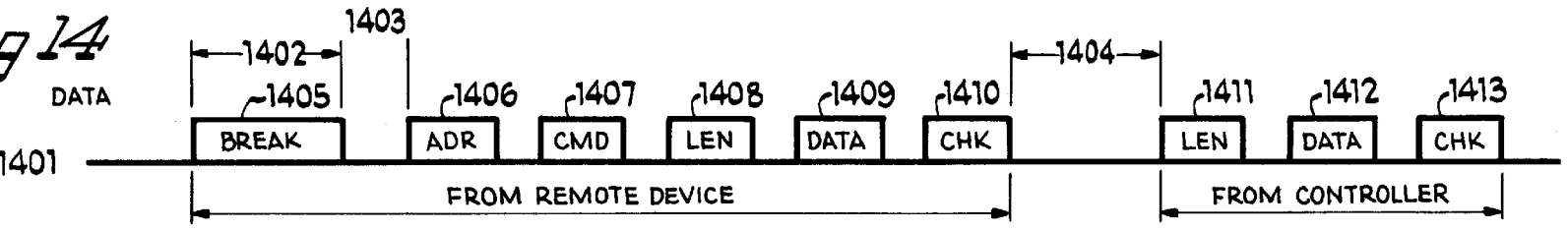
FIG. 14 illustrates a break signal on the data line of the present invention.

Occasionally, under special conditions, a remote 220 relays information to controller 201 without the time delay associated with a strictly polled system. These special conditions include, for example a user pressing a key at a remote or a fire alarm. Referring to FIGS. 2 and 14, to generate a break, remote 220 drives data line 1401 high for a time period 1402 long enough to guarantee framing errors in any ongoing transmission, thereby terminating this transmission until controller 201 retransmits. Break signal 1405 typically lasts longer than a byte, plus the space between two bytes. (See Table 3) In another embodiment, break signal 1405 is shorter with the resultant extra capabilities being required of controller 201 and remote 220. This procedure ensures that most priority messages and alarms get through to controller 201 the first time, with an occasional retransmission being required. In one embodiment of the present invention, the alarm generates follow up breaks, but only at increasing intervals until a maximum interval is reached. This allows the alarm to be heard, but does not allow a broken alarm to get in the way of a functional alarm or the normal operation of the system. The meaning of the alarm is typically included in data field 1409 of the transmission.

After the break signal is sent, remote 220 transmits its message (fields 1406–1410) and receives a response (fields 1411–1413) from controller 201. Table 3 below indicates typical times for periods 1402, 1403 and 1404. Once again, one bit time is approximately 104 $\mu$s. The message from remote 220 includes: address field 1406 which provides the address of the interrupting remote device, command field 1407 which indicates the process that initiated break 1405, and length field 1408 which contains the number of bytes to follow in data field 1409 and checksum field 1410. If the message from remote 220 to controller 201 has no data field, length field 1408 contains a one. The data field 1409 includes any number of bytes from zero to 254. The length of data field 1409 is the above length field value minus one. In the case of a user interface device, a 1-byte keypress value is transmitted as data. The message from the remote device ends with checksum field 1410 which is the same modified Fletcher checksum as described in reference to FIG. 13 (checksum 1315) and FIG. 15.

TABLE 3

| Time | Min | Max |
|---|---|---|
| 1402 | (2 × 9 bt) + 9bt where bt is bit times | (2 × 9bt) + 9bt + 4bt |
| 1403 | 9 bit times | 80 bit times |
| 1404 | 9 bit times | 500 bit times |

It is important that remote 220 (the interrupting device check data line 1401 after remote 220 releases data line 1400 (period 1404) to see if another device is trying to break in. If another device has generated a framing error, the interrupted remote 220 terminates its transmission.

After controller 201 validates checksum 1410, controller 201 responds with a message including fields 1411, 1412, and 1413. The length field 1411 contains the number of bytes to follow in data field 1412 and the checksum field 1413. If the response has no data field, i.e. a simple acknowledgment, length field 1411 stores a one. Data field 1412 contains any number of bytes, from zero to 254. The length of data field 1412 is the value in length field 1411 minus the length of checksum. In the case of a user interface device, display information is transmitted as data. Checksum field 1413 is the same modified Fletcher checksum as described in reference to FIGS. 13 and 15 with the remote address included in the checksum.

After controller 201 asks a remote 220 to perform a task, controller 201 estimates the time required to perform the task, and refrains from sending any more messages to that remote 220 until the required time to perform the task is exceeded. In this manner, remote 220 is freed from unnecessary interruptions and, in effect, may generally ignore the accessory bus 207 during performance of the task. Note that in other embodiments of the present invention, remote 220 does watch for communication during a task.

In yet another embodiment of the present invention, an additional command tells a remote 220 to not generate a break signal for a period of time, for example 10 minutes. This command keeps a remote 220 from interrupting an ongoing query of the database by another remote, or it may prevent an additional interruption of an ongoing data transfer. This embodiment requires a timer and a command to give the timer a value (i.e. 10 minutes or 0/empty). The timer must be empty before a Break signal is issued. When the critical period is done, the timer may be cleared, allowing a break at any time.

In the above-described embodiment of the present invention, remotes 220 are incapable of knowing more than one controller 201. Thus, if the remote 220 receives a message on Attention line 207C, remote 220 assumes the address byte is from controller 201. In other embodiments, multiple controllers share command of the remotes. Because the remotes typically respond to only one controller, this changeover must be transparent to the remotes.

In the embodiment of the present invention shown in FIG. 2, remotes 220 controls actions of actuators, i.e. dampers 214. Additionally, system 200 also provides information on the impact of multiple actuators on a single sensor or how multiple sensors impact a single actuator. Because HVAC system 200 continually compares its predictions with the actual system response, system 200 updates its predictions in real time. In this manner, system 200 compensates for a major change in the environment or the sensitivity or capability of the sensor or actuator.

Figure 3:
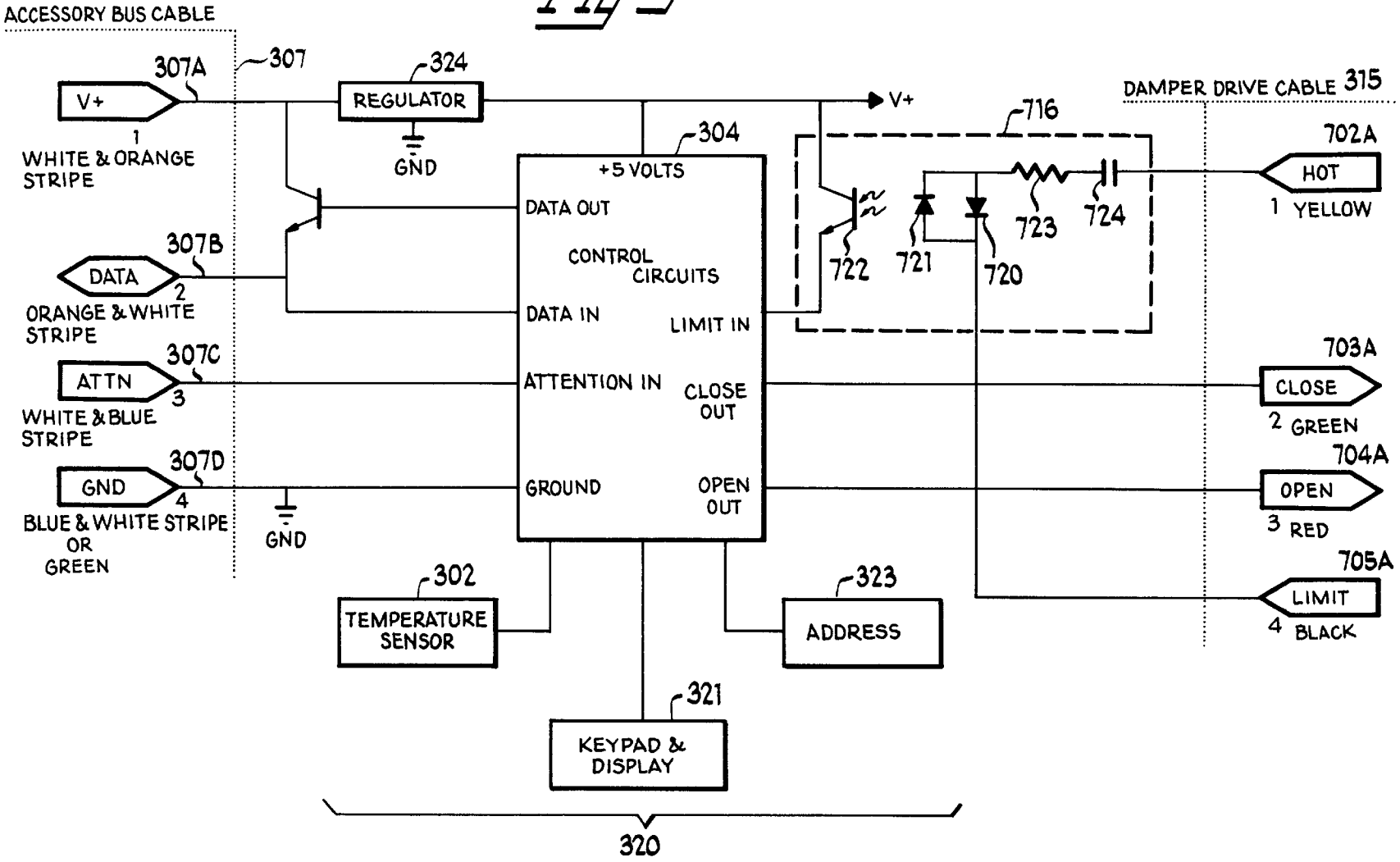
FIG. 3 illustrates a remote in one embodiment of the present invention having a temperature sensor, a keypad/display, a unique address, and a damper actuator interface.

Referring to FIG. 3 remote 320 includes a remote CPU 304, temperature sensor 302, a keypad and display 321, and an address device 323. Interface 716 (explained in detail in reference to FIG. 7A) couples remote CPU 304 to damper driver 315. Remote 320 obtains power from line 307A of accessory bus 307 (via regulator 324) and sends and receives data to controller 201 (FIG. 2) on line 307B on accessory bus 307. Remote 320, with an 8-bit microcomputer and 11.059 mHz clock, draws too much current for the accessory bus ground line 307D. Thus, in this embodiment, the present invention includes a 12 gauge ground line 208 (FIG. 2) which parallels accessory bus 207.

Capacitor 724 and resistor 723 limit the current through the back-to-back diodes 721 and 720. Diode 721 is an emitter which generates photons which in turn tends to turn on the phototransistor 722. Diode 720 limits the reverse voltage across diode 721.

FIG. 11 illustrates one temperature sensor 302 in accordance with the present invention. Referring to FIG. 11, temperature indicator 1103 samples ambient air at the lower entrance 1104 of a hollow member 1101. A heating element 1102, positioned near the upper entrance 1105 of member 1101, generates heat. Heating element 1102 includes, for example, a regulator or a resistor to generate the needed heat. This heated air rises and exits member 1101, thereby drawing in replacement (i.e. ambient) air from lower entrance 1104.

In conventional temperature sensors, the temperature indicator samples still air which is adversely affected by the wall temperature. Specifically, typical room walls have a 15 to 20 minute thermal time constant. In other words, even if the actual room temperature were changed from an overnight temperature setting (i.e. 55 F.°) to a morning temperature setting (i.e. 75 F.°) in 3 minutes, the walls remain cool for a much longer period. Because part of the "feeling" of warmth is from the air and part is from the walls, the thermal time constant of temperature indicator 1103 is preferably tuned to match that of the room. In other words, having temperature indicator 1103 indicate a temperature between those two values causes the air temperature to be controlled above the set point until the wall temperature rises. Thus, in accordance with the sensor of the present invention which creates an air flow, temperature sensor 302 ensures that a more accurate sampling of the ambient air in the room is provided to temperature indicator 1103. In another embodiment, temperature indicator 1103 minimizes impact of wall temperature through placement of temperature sensor 302, as well as the material and shape, i.e thermal path, detected for sensor 302. For example, using stainless steel (which is a poor conductor) for mounting sensor 302 to the wall is preferable to using copper (which is a good conductor). In other words, the less conductive the material, the more sensor 302 is isolated from the wall conditions. In this manner, temperature indicator 1103 provides mainly the air temperature and controller 201 (FIG. 2) compensates for the temperature of the walls by considering the air temperature history and the probable wall temperature.

A typical temperature indicator 1103 includes a National Semiconductor LM34 temperature-to-voltage converter which generates a voltage of 10 mV per degree Fahrenheit. This voltage is amplified by a factor of 3 to 30 mV per degree Fahrenheit and is then provided to a National Semiconductor ADC0804 8-bit analog-to-digital converter. In accordance with the present invention, the ADC reading is added to an offset to reference the modified reading to −40. The modified reading is converted to Centigrade by subtracting an offset and then dividing the value by 9. On the other hand, the modified reading is converted to Fahrenheit by subtracting an offset and then dividing by 5. Because temperature reading is in ⅑ C.° or ⅕ F.° steps above −40 F./−40 C., any inaccuracies due to rounding during conversion are eliminated.

Temperature sensor 302 of remote 320 (FIG. 3) is set for ⅕ F.° steps above +44.4° thus can indicate 255 steps above there to +96.4°. Other embodiments of the present invention provide additional conversion resolution to cover a broader range. For reduced accuracy requirements, the step size is doubled, thereby extending the range for an 8-bit measurement without sacrificing the convenience of the conversion scheme. However, note that some temperatures in this doubling scheme include some quantitizing error (for example, if 64.0 is available, then one degree higher would be 64.8 or 65.2). The reading and conversion process of remote 220 (FIG. 2) is typically repeated at least once a second to ensure a current response for controller 201.

Figure 5:
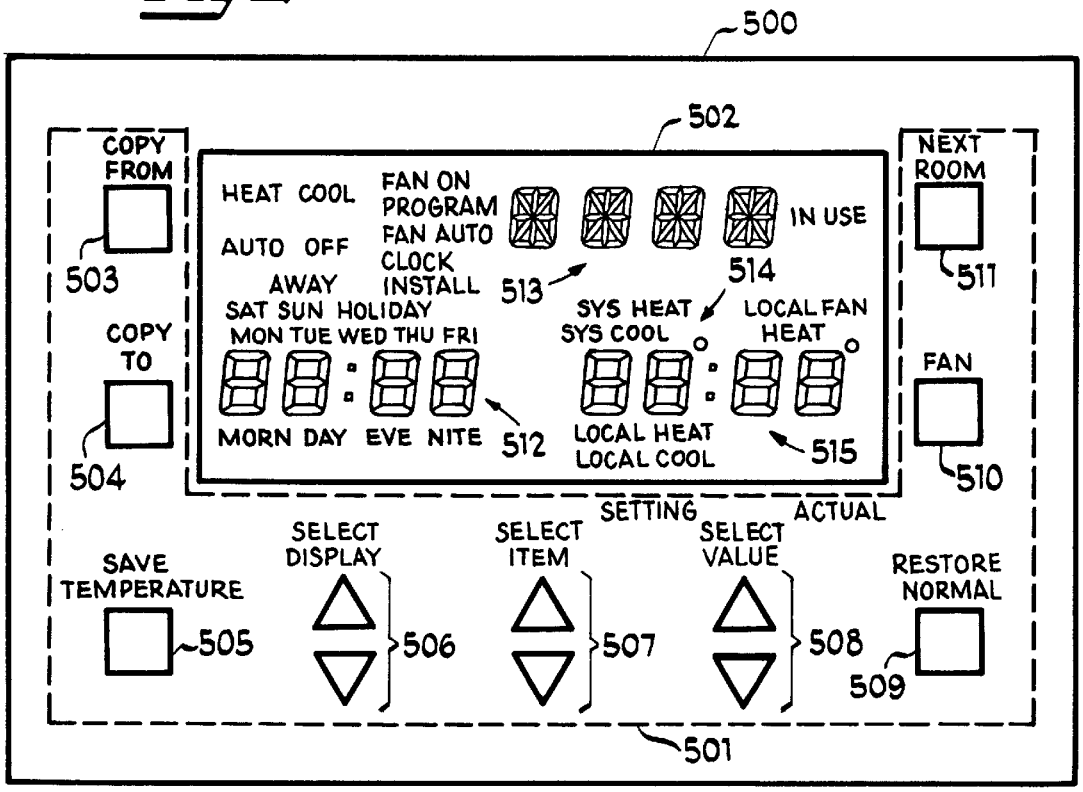
FIG. 5 illustrates an example of a keypad/display for the large version remote of the present invention.
Figure 6:
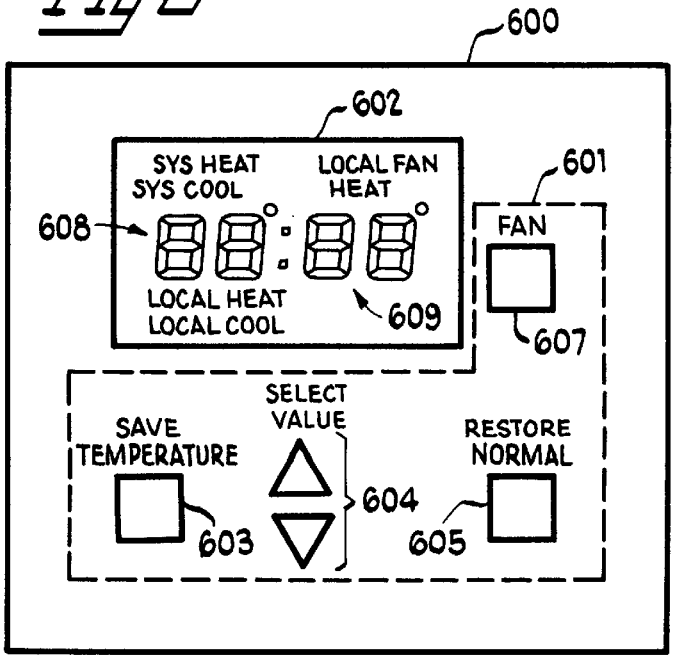
FIG. 6 shows an example of a keypad/display for the small version remote of the present invention.

FIGS. 5 and 6 show illustrative keypads/displays in accordance with the present invention for remote 220.

Referring to FIGS. 2 and 5, a housing 500 provides support for a keypad 501 and a display 502 (keypad/display 321 of FIG. 3). A group of three key pairs 506, 507, and 508 allow the user to program controller 201 to custom design temperature conditions within the home. The user presses one button of the key pair 506 to select the desired "active" display functions. These functions include, for example, Program, Clock and Install. After selecting a particular function, the user presses one button of the key pair 507 to move between the fields without changing the selected function. For example, if the user is in the "clock" function, the user may move from the day of the week field to the hour of the day field, or the minute field. Typically, the selected field is flashing. The user changes the current value shown in the field by pressing one button of key pair 508.

Using controller 201, the user has the capability to program the temperature of each room in the house. Specifically, after entering a "program" function as indicated on display 502, the user selects the room to be programmed by pressing key 511. Note that a designated name for each room, i.e. for each remote device 204, is typically input by the installer during an initial "install" function.

After selecting the desired room, the user selects the desired day (i.e. Monday . . . ) and time period (i.e., start time as well as heat and cool setpoint temperature. This setting is copied from one room to another by first pressing button 511 until the room the user desires to copy from is shown on display 502. Then, the user presses button 503 to copy all data (time and temperature) from that room into a buffer where it will stay for a maximum 3 minutes. Then the user presses key 511 as needed until the room to copy to is shown in display 502, and then presses key 504 to perform the copy to using the data from the buffer. If this copy procedure is completed within 3 minutes, controller 201 considers the request valid. If the procedure takes longer than 3 minutes key 504 will be ignored, the user must repeat the procedure.

If the user wishes to change the temperature of a particular room, the user verifies the desired room is shown on display 502. If the desired room is not shown on display 502, the user presses key 511 as necessary. Then the user presses one of the buttons of key pair 508 to indicate the desired temperature. At this point the user has these options: 1) save the temperature for that day and time period by pressing button 505, 2) pressing restore normal button 509 to return to the last programmed temperature setting, for that particular day and time period, or 3) leaving the temperature at its new setting. At the first time period change after 2 hours, the temperature will revert to the programmed temperature.

The user activates a fan by pressing key 510. Note that while the furnace or the air conditioner is running, the fan is low priority. Thus, controller 201 only validates request for fan operation if the furnace or air conditioner are not running.

FIG. 6 illustrates a housing 600 for another remote 220. Similarly to housing 500 housing 600 provides support for both a keypad 601 and a display 602. However, other buttons such as Next Room key 511 (FIG. 5) and Copy From key 513 are missing on keyboard 601. Thus, the user is limited to programming the temperature for one room using keyboard 601. Note that the display translation routine is changed if an external switch (not shown) is closed on the internal display board, thereby indicating that a different type of display, i.e. the display for remote 220 illustrated in FIG. 6, is present. In this manner, the remote CPU has the capability to drive either display 502 or display 602. As mentioned previously, if the user presses a button on remote 220, any ongoing message on accessory bus 207 is interrupted, and a message indicating the key the user pressed is sent to controller 201. Typically, controller 201 periodically (i.e. every 100 msec) asks for the status of keypad 501 or 601, thereby determining if any buttons on those key pads are still down until none are down.

The present invention includes any one of a number of different "key-down" schemes. These schemes include, for example, sending a message continually while the key is being pressed, sending a message when the key is pressed and another message when the key is released, or sending a message when the key is pressed and allow monitoring of the status of the key. Continual transmission (the first scheme), may consume a significant fraction of the throughput on accessory bus 207, especially if remote 220 has a key shorted. Thus, a continual transmission scheme is typically avoided. The second scheme, key-down and key-up triggering, particularly viable if key up timing is important. However, in the present invention, only the keydown timing, is of interest generally. The third scheme, key down plus status readings, minimizes bus utilization by allowing controller 201 to decide when to sample key down.

In any of the above-described key-down schemes, controller 201 either single steps or accelerates steps as needed. For example, in one single step mode, moving from Monday to Monday takes seven key presses. In another single step mode, holding the key down changes the display one step per second. In contrast, in an accelerated step mode, holding a key down accelerates the rate at which the display changes, thereby allowing the user to move from, for example, 45° Fahrenheit to 90° Fahrenheit in less than 50 keypresses or 50 seconds. In a hybrid mode, if a key is held down, the display changes at one step per second. However, by the time the key is held down for five seconds, the display changes at ten steps per second.

In this embodiment, debouncing, i.e. the elimination of undesirable signals that result from mechanical contact bounce until the contact is finally closed or opened, is ensured by first identifying a key down (the front edge), followed by off for all samples for 200 milliseconds as the condition for a key-up (the trailing edge). In this manner, debouncing also contributes to a lower maximum bus utilization since 5 presses per second would be an unlikely maximum for all keys on one remote.

Neither keypad 501 nor keypad 601 has diodes for separating multiple simultaneous keypresses. Holding one key down while sequentially pressing two other keys is used to enter a special mode. Upon entering a special mode, remote 220 initializes itself, then waits for instructions. Initialization includes resetting an orphan timer (explained in detail below) to 30 seconds, opening the damper, and initializing the states of all the software processes. In one embodiment of the present invention, the first keypress of remote 220 after entering the special mode triggers a self-test mode. This self-test mode ends if controller 201 communicates with any remote 220 in any manner. In the self-test mode, remote 220 reads and displays its own temperature and moves its associated damper 214 in a pattern which demonstrates to the user that this remote 220 is functional.

Remote 220 are typically mounted to a wall with conventional mirror mounting hardware, or are screwed into wall anchors.

Each remote 220 is fabricated with a long, unique random number, i.e. address device 323 (FIG. 3). In one embodiment the long, unique random number is 48 bits, i.e. six single bytes. In accordance with the present invention, remote CPU converts this long, unique random number into a single byte random number using a hashing function, for example.

After installation or after a power-down/power-up sequence, each remote 220 sends a message containing its long serial number to controller 201. Therefore, all remotes 220 are in competition with one another to communicate with controller 201. This competition triggers a "fish" sequence in controller 201. Specifically, controller 201 sends a Fish #1 Command to all remotes with address 0 followed by 32 bytes of 00hex (i.e. start bits). Those skilled in the art will recognize that "hex" refers to the hexadecimal numbering system having as its base the equivalent of the decimal number 16. Remote 220 considers its serial number and determines a response number between 0 and 255 using a preprogrammed Fish #1 algorithm. During receipt of the 32 bytes from controller 201, each remote 220 counts until its response number is "called". If a single address 0 remote 220 responds to a response number to Fish #1, controller 201 assigns it a single byte address and records its long, unique random number for later use. If controller 201 is unable to talk to a single remote 220 (probably because of multiple remotes 220 responding), then the process is repeated using the Fish #2 command, wherein each fish sequence number triggers a change in the process of developing the response number. The "Fish" sequence is continued from Fish #1 to Fish #6, and then repeated until no more response numbers are seen or until no new information is obtained with a full cycle from Fish #1 to Fish #6.

In another embodiment of the present invention, after a power-down/power-up sequence, controller 201 skips the Fish sequence and uses a stored list of long, unique numbers of remotes 220 to assign short addresses to remotes 220 which respond at address 0 until these short addresses are assigned.

In accordance with the present invention, if a remote 220 is added to system 200, the new remote 220 initially waits approximately 30 seconds (set by an internal timer) for controller 201 to establish communication. However, if after 30 seconds, communication is unsuccessful between controller 201 and the new remote 220, that remote 220 (the "orphan") calls out to introduce itself to controller 201. After a successful introduction, the internal timer is set to about one hour. Subsequent communication between controller 201 and remotes 220 resets this timer. Thus, typically, the timer never counts out. However, if for example controller 201 is removed and another controller is substituted, remotes 220 time out and join the new controller, either one at a time, or if the new controller begins the above-described fish process, then all remotes 220 are found in a shorter period of time.

Figure 4B:
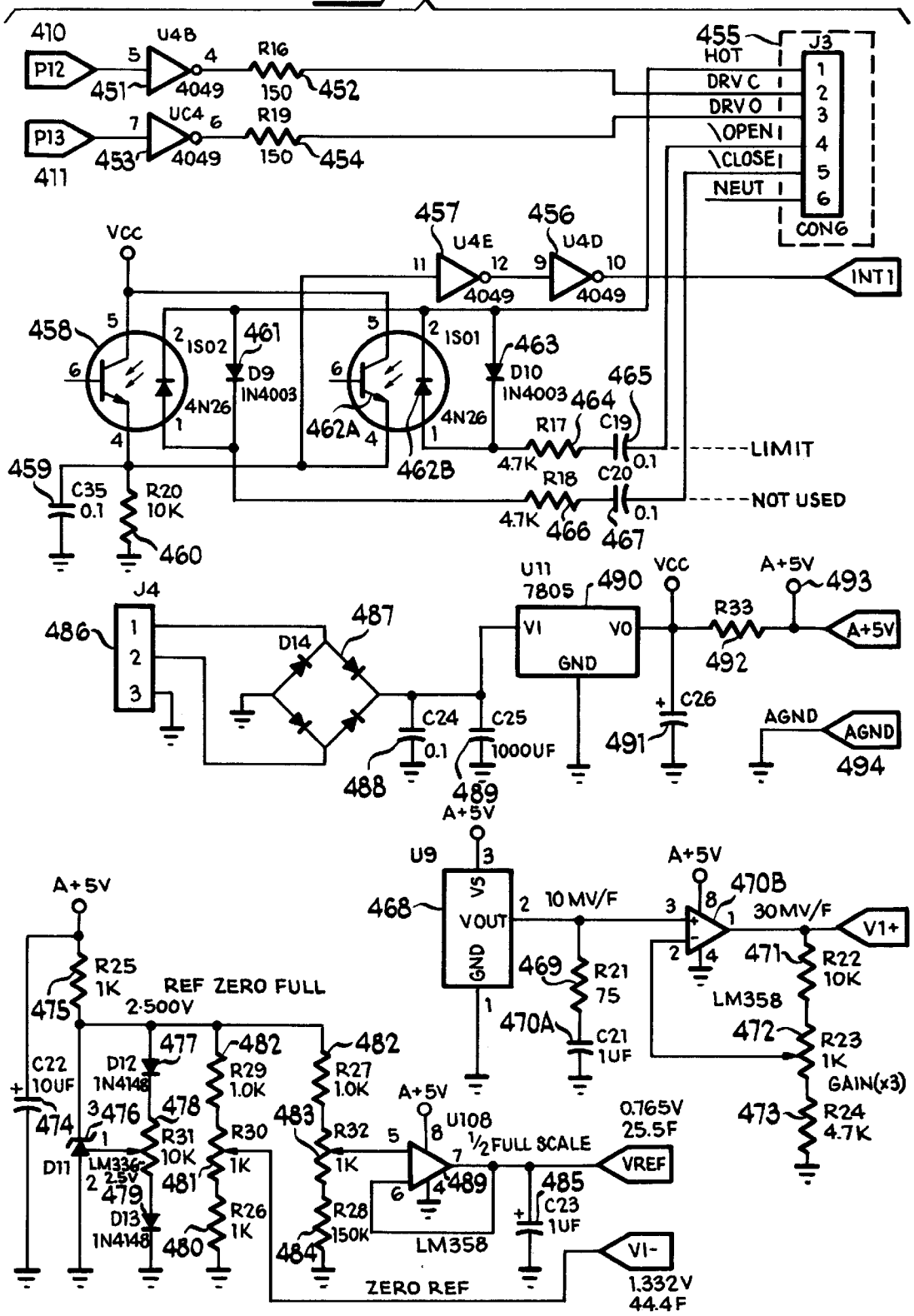
FIG. 4B shows another partial circuit diagram of the sensor of FIG. 3.

FIGS. 4A and 4B illustrate a schematic diagram of a remote 220 in accordance with the present invention. Referring to FIG. 4A, the central processing unit (CPU) 414 is an 8-bit microprocessor. Capacitors 405 and 404, resistors 401 and 403 and the 11.0592 MHz crystal 401 are configured to allow operation of CPU 414 at 11.0592 MHz. Resistor 408 and capacitor 407 are conventional components to provide the power-on-clear function for CPU 414. Connections 406 and 407 provide a reset function.

Output lines P0.0 to P0.7 provide signals from CPU 414 during certain predetermined times. At other predetermined times, both output lines P0.0 to P0.7, as well as lines P2.0 to P2.7 provide address signals to the input terminals A0 to A15 of programmable system device (PSD) 415. PSD 415 includes 32 k bytes of electrical-programmable read-only-memory (EPROM) for storing the software program and 2 k bytes of static-random-access-memory (SRAM) and I/O lines.

The control lines for CPU 414 include a read line $\overline{RD}$, a write line $\overline{WR}$, an address latch enable line ALE/$\overline{P}$. Note that one edge of a signal on line ALE/$\overline{P}$ tells PSD 415 to latch in the address signals on lines P0.0–P0.7 and P2.0–P2.7. Lines P0.0 to P0.7 of CPU 414 are also connected to an analog to digital converter (ADC) 428 which takes the voltage difference between terminals VI+, VI−, and then converts that voltage difference compared to twice the difference between the VREF and the GND into a digital signal to be read by CPU 414 using the chip select pin CS and the read pin RD of ADC 428.

Lines PA0–PA7 are further coupled to buffer 416 which drives a connector 422. Lines PB0–PB7, coupled to PSD 415, provide signals to another buffer 417, which also drives connector 422. Connector 422 is coupled to conventional display driver and keypad circuits. Pins 16 and 17 on connector 422 provide input signals to buffer 417 via resistors 418 and 419 (which provide electric static discharge (ESD) protection) and pull-down resistors 920 and 921. Pins 16 and 17 are thus related to output pins 2Y3 and 2Y4 which provide signals to PSD 415. These signals are then readable by CPU 414. In this manner, CPU 414 writes to connector 422 (pins 1 through 15 on connector 422) and reads connector 422 (pins 16 and 17 of connector 422).

Lines PA0–PA7 of PSD 415 are also coupled to a DIP switch 424 via series diode series 423. If the signal on line PA0 is held positive by CPU 414 acting through PSD 415 and the other signals on line PA1–PA7 are held to a zero, then diode D1 in diode series 423 conducts, raising the voltage on pin 1 of DIP switch 424 to a positive level. If DIP switch 424 is closed, then output pin 16 pulls to a positive level, thereby overcoming the pull-down resistor 427. If DIP switch 424 is open, then the effect of pull down 427 resistor generates a zero signal at pin 16. The signal generated by DIP switch 424 passes through resistor 426, and is then provided as an input signal to invertor 425 which in turn provides the inverted signal to an input terminal of CPU 414.

Input/output terminal P1.5 of CPU 414 is coupled to a Dallas Semiconductor commercially available DS2400 chip 431, which provides the above-described unique, 48-bit, serial number. Note that in this embodiment either DIP switch 424 or the serial number provided by chip 431 is used, not both. Resistor 429 and capacitor 430 perform conventional functions relating to the clock operation of ADC 428 and therefore are not described in detail herein.

The output signal from terminal TXD of CPU 414 passes through a large series resistor 450, and attempts to drive the input line of unbuffered CMOS invertor 434. Because the output line of invertor 434 is coupled to its input line via capacitor 433, the RC charging only precedes until one-half. Then as the output signal from invertor 434 starts switching, capacitor 433 stops any changes in the signal on the input line to invertor 434. After the signal on the output line of invertor 434 reaches the rail, additional RC charging of the input line occurs. The output signal of invertor 434 is provided to the base of transistor 435.

The collector of transistor 435 is connected to the voltage supply. The emitter of transistor 435 following within 0.7 of volts of the voltage provided on its base, is connected through a current limiting resistor 436 to an input pin 02 on the accessory bus connector 449. The outgoing and more important the incoming signal from the pin 02 on the accessory bus connector 449 passes through an RC filter consisting of resistor 441 and capacitor 440, eliminating any ESD or RFI that might be on the line. This signal is then inverted by invertor 439 and inverted a second time by invertor 438. The output signal from invertor 438 is fed back through a very high value resistor 437 to the input of invertor 439, thereby developing a small amount of hysteresis. In this manner, once switching has occurred, the input signal needs to change back a small amount before switching in the other direction occurs. The output signal of invertor 439 is provided to the RXD terminal on CPU 414. The attention line, coupled to pin 03 on accessory bus connector 449, passes through a similar block (including resistor 443 and 446, capacitor 445, and invertors 444 and 442). The output signal from invertor 442 is provided to the input pin P1.0 of CPU.

Referring to FIG. 4A and 4B, lines 410 and 411 are coupled to output terminals P1.2 and P1.3, respectively, of CPU 414, which in turn are coupled to invertor 451 and 453, respectively. The output signal of invertor 451 passes through a current-limiting resistor 452 and is then provided to a connector 455. Similarly, the output signal of invertor 453 passes through a current-limiting resistor 454 and is also provided to connector 455.

Note that phototransistor 462A, diode pair 462B and 463, resistor 464, and capacitor 465 are, in fact, phototransistor 722, diode pair 721 and 721, resistor 723, and capacitor 724 (FIG. 3). Damper driver cable 315 (FIG. 3) is coupled to pins 1–4 of connector 455.

The buffered signal from invertors 457 and 456 is provided to CPU 414 via line 409 (FIG. 4A). Power supply connector 486 provides a signal to a full wave bridge 487, which in turn generates a DC voltage on a decoupling capacitor 488. Capacitor 489 is the main storage capacitor for that DC voltage. Regulator 490 generates a 5 volt signal referenced VCC. This signal passes through resistor 492 where it becomes the analog +5 volts at node 493. Decoupling capacitor 491 is connected to VCC and ground.

A temperature-to-voltage sensor 468, generates a voltage which is 10 millivolts times the temperature in Fahrenheit. Resistor 469 and capacitor 470A filter the signal before it is provided to the non-inverting input terminal of operational amplifier 470B.

The output signal of amplifier 470 is divided by the series combination of resistors 471, 472 and 473. The one-third level value is fed back to the inverting input of amplifier 470. In this configuration, amplifier 470 stabilizes when VI+ is three times the output signal from converter 468, i.e. 30 nmillivolts per degree.

Capacitor 474 filters the analog +5 volts 493. A voltage reference chip 476 generates approximately 2.500 volts. The temperature compensation circuit including diode 477, potentiometer 478, and diode 479 compensate for the ambient temperature. The 2.500 volts generated by chip 476 is divided by the series combination of resistor 482, potentiometer 481, and resistor 480 to generate the zero reference voltage VI− 1.332v, which is in turn provided to ADC 428 (FIG. 4A). The same 2.500 volts is divided using a series combination of resistor 482, potentiometer 483, and resistor 484 to generate a voltage which is then buffered by amplifier 484 to generate a referenced voltage for use by the ADC which is equal to one-half the full scale input range to the ADC 428 0.765.

Note that in the embodiment of the present invention described for FIGS. 2 and 4, using CPU 414 to also perform the CPU functions for damper driver 213 added a cable 215 from remote 220 to damper driver 213. In accordance with another embodiment, a second CPU is included with damper driver 213. This allows accessory bus 207 and the 24 vac motor power to go direct to each damper remote 214 which is located near or in damper 214.

Figure 7A:
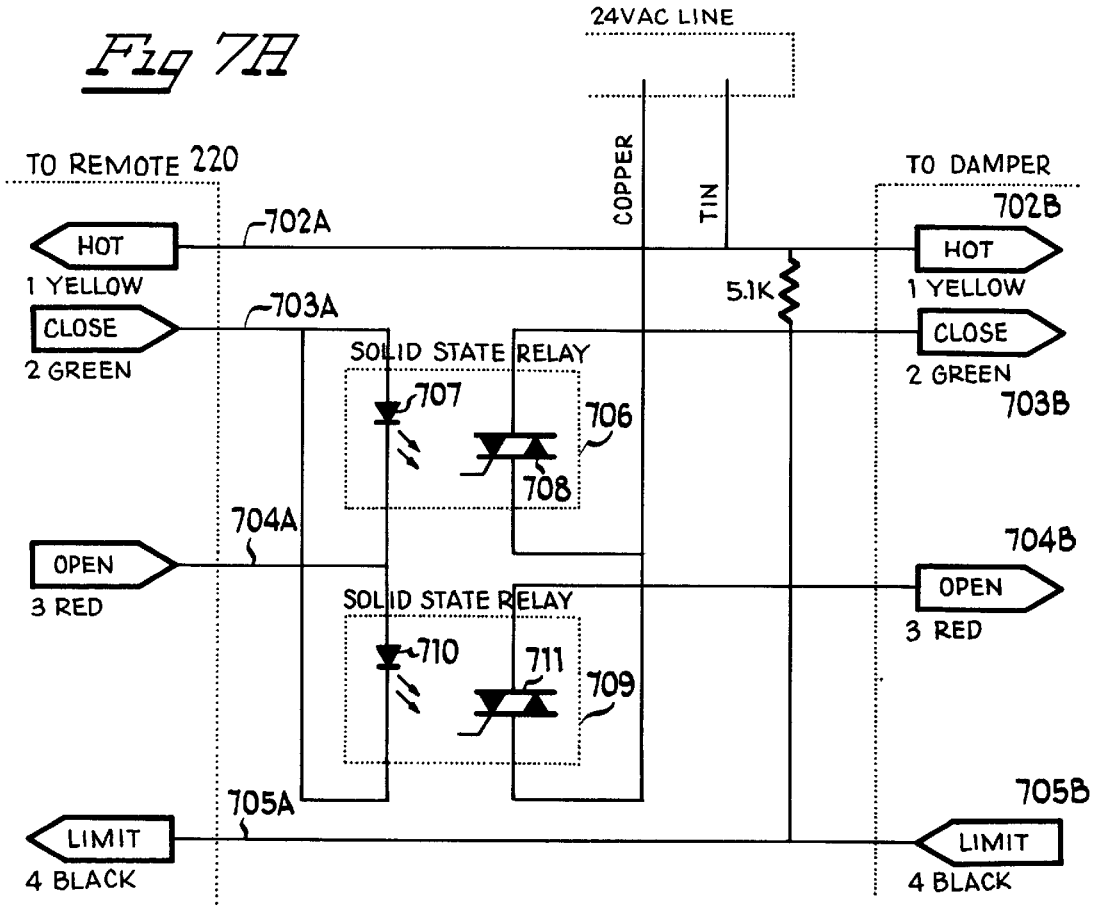
FIG. 7A illustrates a circuit diagram of a damper driver in one embodiment of the present invention.

FIG. 7A illustrates a damper driver circuit 213 in accordance with the present invention. Lines 703A and 704A, "close" and "open" lines, respectively, from remote 220 are coupled to solid state relays 706 and 709. Note that line 703A is connected to the anode of photoemitter 707 and the cathode of photoemitter 710. Likewise, line 704A is coupled to the cathode of photoemitter 707 and the anode of photoemitter 710. This configuration prevents relays 706 and 709 from generating current (i.e. turning on the solid state relay) at the same time. However, both solid state relays are turned off if the signals on lines 703A and 704A are same polarity.

If the signal on line 703A is more positive than the signal on line 704A, then photoemitter 707 draws current and generates photons. These photons generate current in device 708 of solid state relay 706, which activates the motor 715 shown in FIG. 7B to close the damper. If the signal on line 704A is more positive than the signal on line 703A, then photoemitter 710 draws current and generates photons. These photons generate a current in device 711 which activates motor 715 to open the damper.

The power driving line 212 (FIG. 2) is UL Class II, thereby ensuring against fire or electrocution. In one embodiment, line 212 is a 16 gauge speaker wire pair. Line 212 is run from power box 211 to each damper drivers 213 in either a daisy-chain, a star or a combination configuration. A conventional "IT" connection at each damper driver 213 facilitates installation.

Figure 7B:
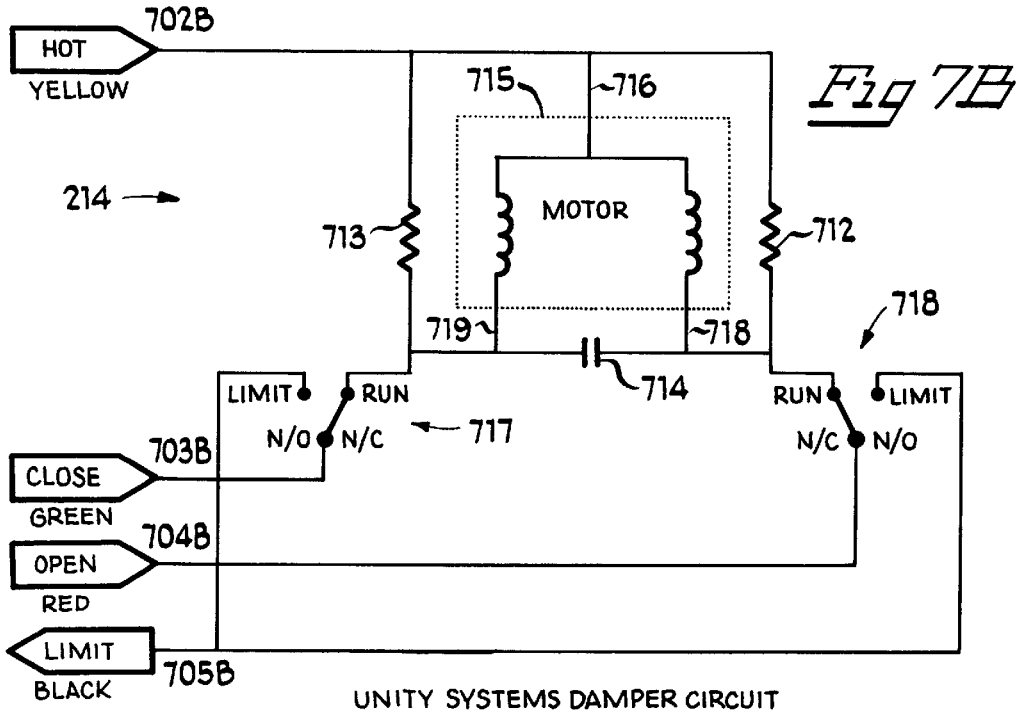
FIG. 7B illustrates a block diagram of a damper mechanical assembly with motor in accordance with the present invention.

Referring to FIG. 7B, damper 214 includes a bidirectional motor 715 having three legs 716, 718 and 719. If 24 volts AC is provided between legs 716 and 719, then motor 715 turns in a direction to close the damper platter (not shown). If 24 volts AC is provided between legs 716 and 718, then motor 715 turns in a direction to open the damper platter. In this manner, only one of legs 718 and 719 is driven at a time. Each limit switch 717 and 718 is activated by its specific mechanical position, i.e. open or closed. If motor 715 is driven up against limit switch 717, for example, then limit switch 717 switches from the "run" position to the "limit" position. Capacitor 714 and resistors 712 and 713 are standard in the industry and therefore are not explained in detail. In one embodiment of the present invention, damper 214 is a commercially available Unity Systems damper, part number 991-0006.

Damper 214 further includes a pipe (not shown) of radius $R_p$ and a circular damper platter (not shown) of radius $R_d$. Radius $R_p$ is typically slightly greater than radius $R_d$ to ensure the damper platter fits properly in the pipe. In one embodiment, radius $R_p$ is approximately 3.0 inches (7.620 cm) and radius $R_d$ is approximately 2.86 inches (7.264 cm). The damper platter rotates from zero degrees, representing no restriction on air flow, to 90 degrees, representing substantially 100% restriction on air flow. It is well known to those in the art that air flow is proportional to the un-blocked area between the damper platter and the duct.

Remote 220 (FIG. 2), after receiving driver signal commands from controller 201, enable damper drivers 213 to drive motor 715 (FIG. 7) to either open or close the damper platters for the required time to achieve the flow requested in the command. The remote CPU 304 (FIG. 3) in remote 320 (described in detail in reference to FIG. 4) senses the limits of rotation of the damper platters, thereby verifying movement of the damper platters as well as allowing calibration.

A circular damper platter forms an ellipse of varying area depending upon the angle of rotation. The area of an ellipse, and thus the damper platter, is equal to $\pi R_d \times b$, where b is equal to $R_d \times \sin\theta$. Therefore, the flow of air through the duct is derived from the following equation:

$$\text{Flow} = \frac{\pi \cdot R_p^2 - \pi \cdot R_d^2 \cdot \sin\left(\theta \cdot \frac{\pi}{180}\right)}{\pi \cdot R_p^2} \cdot \text{Flow open} \qquad \text{Eq. 1}$$

Note that because of the difference between radius $R_d$ of the duct and radius $R_p$ of the pipe there is an annular ring of air flow even when the damper paddle fully blocks the duct.

$$\theta = -\frac{180}{\pi} \cdot a\sin\left[\frac{\left(\frac{\text{Flow}}{\text{Flow}_{open}} \cdot R_p^2 - R_p^2\right)}{R_d^2}\right] \qquad \text{Eq. 2}$$

FIG. 10 illustrates graphically the relationship between the requested % flow (horizontal axis) and the actual flow in one case, and the required θ in the second case, and the ideal flow all using the same vertical axis. In one embodiment of the present invention, a look-up table facilitates converting the % flow to a desired angle. FIG. 9 lists a partial look-up table with flow values 900 and angles 901.

Messages on data line 207B of accessory bus 207 include instructions for damper 214 to move to a pre-determined % of unobstructed air flow. Controller 201 needs to know whether damper 214 was able to meet the request, or failing that, it needs to know the best estimate of where damper 214 was set. Specifically, remote 220 answers status queries from controller 201 with messages indicating whether the damper move is complete, whether the move was probably successful, and whether a prior error in the contacting a limit switch has cast doubt on the validity of the determination of whether the move was completed correctly.

To make this determination, remote 220 first times the rotation of the damper platter from limit to limit, assuming 90 degrees of rotation. After this initial measurement, remote 220 determines the rotation from a known position by tracking the cumulative rotation time and direction from the known position.

Figures 8, 8A, 8B:
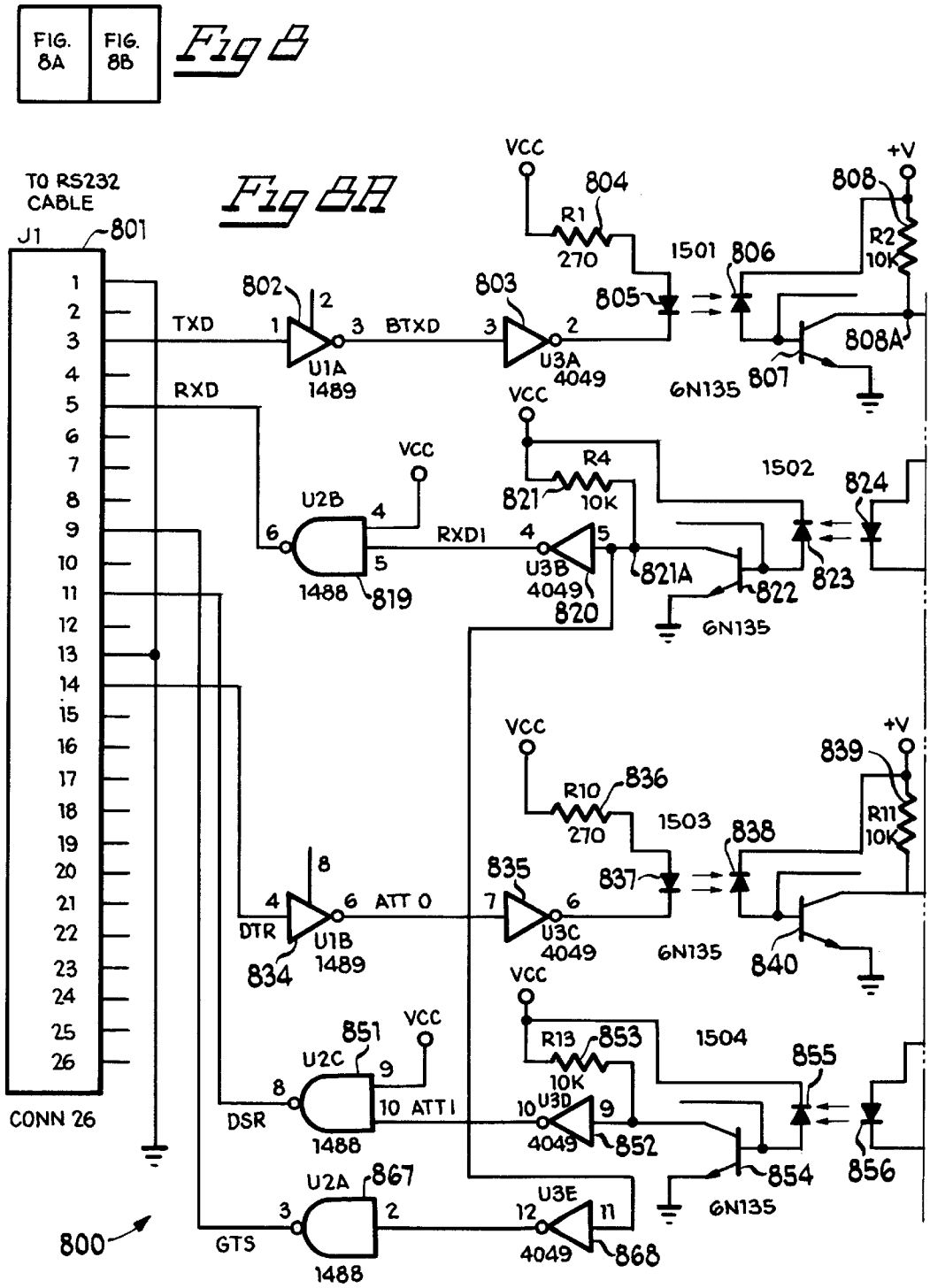
FIG. 8 shows a circuit diagram of an accessory bus PC interface in the present invention.
Figure 8B:
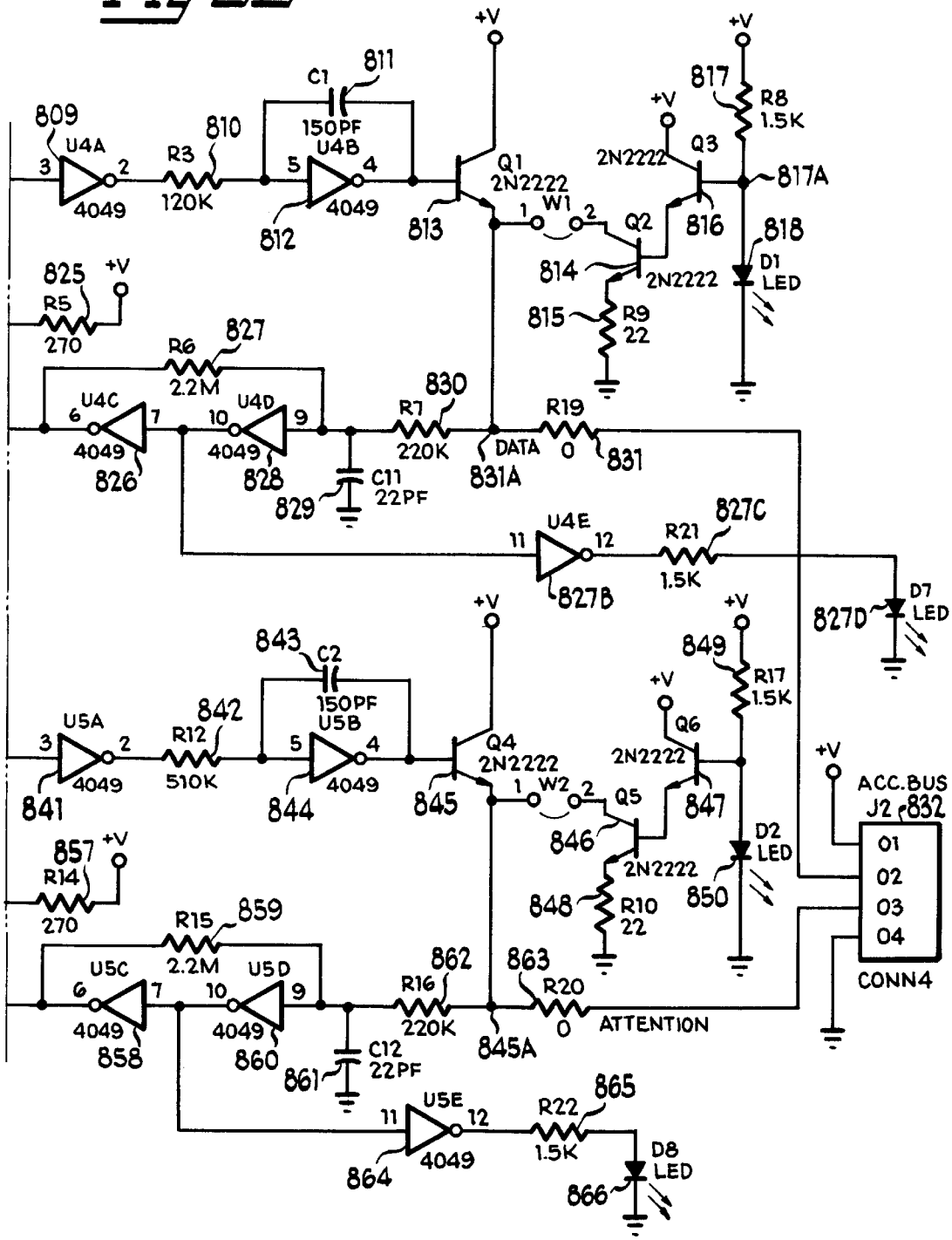

FIG. 8 illustrates an accessory bus PC interface 800. Connector 801 is connected to a standard RS232 Serial cable with a 25-pin "D" connector. Pin 3 of connector 801 provides a signal which is first level shifted by invertor 802 and then inverted again by invertor 803. The twice-inverted signal generates a current through IR emitter 805. This current is limited by the series resistor 804, which is positioned between IR emitter 805 and voltage supply Vcc. A current in IR emitter 805 generates photons which in turn generates a current in photodiode 806 and a current in transistor 807. Current through transistor 807, which is coupled to ground, pulls the node 808A to zero. If IR emitter 805 generates no photons, no current flows through photodiode 806 or transistor 807. In this manner, resistor 808 generates a one at node 808A.

The signal on node 808A is inverted by invertor 809 and passes through a slope generator circuit including resistor 810, capacitor 811, and invertor 812. RC charging occurs between resistor 810 and capacitor 811 as the voltage on the input line of invertor 812 rises to approximately the one-half point where invertor 812 starts switching. At this point, the voltage on the input line of invertor 812 remains constant as the output swings developing a current through capacitor 811 which matches the current through resistor 810. After this output voltage swings as far as it can up against the rail, RC charging continues. During the period when output of invertor 812 is moving, an increasing voltage is provided on the base of transistor 813, which in turn provides an increasing voltage on the emitter of transistor 813. The buffered current is provided through the collector which is connected up to the positive voltage supply. The emitter of transistor 813 is connected through resistor 831 to accessory bus connector 832 pin 02. If this PC functions as the controller, a jumper is positioned in gap W1, thereby allowing transistors 814 and 816 and resistor 815 to pull node 813A toward zero.

Resistor 817 provides current to pull up the voltage on the anode of LED 818 to about 1.6 volts. The anode of LED 818 is also connected to the base of transistor 816. The emitter of transistor 816 is approximately 0.7 volts below the voltage on its base. Because the base of transistor 814 is connected to the emitter of transistor 816, the emitter of transistor 814 is approximately 1.4 volts below the voltage on node 817A. The amount of current to keep that point at that voltage is provided by the gain of transistors 814 and 816. That voltage, dropped across resistor 815, provides a pull-down current of approximately 10 milliamps.

Pin 02 of accessory bus connector 832 also provides a incoming signal which passes through resistor 831 and a filter including resistor 830 and capacitor 829. Invertors 826 and 828 and resistor 827 provide some hysteresis. Optionally, signal on node 827A is passed through a buffer 827B resistor 827C to drive an LED 827D. Thus, LED 827D indicates the state of node 827A.

The signal on the line from invertor 826 output drives photoisolator input IR emitter 824, which in turn generates photons. These photons generate a current in photodiode 823 which provides a current in the base of transistor 822. This current is sufficient to turn on transistor 822 which pulls the voltage on node 821A to ground. The signal on node 821A is inverted by invertor 820 and then is provided to one input terminal of NAND gate level shifter 819. The other input terminal of NAND gate 819 is held enabled to voltage Vcc. Thus, the output signal from NAND gate 814 approximates levels close to +12 and −12 volts. This output signal is provided to pin 5 of connector 801.

Table 4 below provides a reference between the RS232 names and the pins of connector 801, which is designed for use with ribbon cable to connect to an RS232 connector, and input/output signals on the data and attention lines of the accessory bus.

| PIN | DESIGNATION ON RS232 | ACCESSORY BUS |
|---|---|---|
| 9 | CTS | Input signals from Data line.[1] |
| 11 | DSR | Input signals from Attention line.[1] |
| 14 | DTR | Output signals to Attention line.[1] |
| 3 | TXD | Output signals to Data line.[2] |
| 5 | RXD | Input signals from Data line.[2] |

Where [1]status and [2]serial data.

Pin 14 of connector 801 provides a signal on data terminal ready (DTR) line (also referred to as the Attention line). This signal passes through level shifter invertors 834 and 835, optoisolator 837, diode 838, transistor 840, resistor 841, a filter including resistor 842, capacitor 843, and invertor 844, transistors 845, 846 and 847 resistors 848, 849 and LED 850. These components function in a manner similar to that described for elements 802–818 and therefore are not described in detail. The emitter of transistor 845 is connected to node 845A. Level shifter 867 and invertor 868 act like 819 and 820 and share the input from note 821A, but drive a pin CTS on connector 801 which is readable by the PC unlike the RXD which is only useful for accepting serial data. Components 851–863 sense the signals on the attention line. Components 851–863 function similarly to components 819–831 and therefore are also not explained in detail. To act as a remote, jumpers W1 and W2 are removed so that there is no pull-down current provided by this unit.

HVAC system 200 (FIG. 2) is pre-programmed with times and temperatures which provide comfortable, cost-efficient heating and cooling operations for either a typical "away from 8 to 5 on weekdays" household or a "mostly home" household. Typically, the installer determines which of the two household patterns is appropriate and then sets HVAC system 200 to this pattern. The installer also inputs room names into controller 201 and then identifies the remote devices corresponding to each room name. At this point, HVAC system 200 provides a user-responsive system.

As mentioned previously, at any time, a user may press a key (FIG. 6) on remote 220 to request that controller 201 increase/decrease the room temperature temporarily. Controller 201 responds by adjusting the target temperature for that zone (i.e. room) without regard to the last programmed or default schedule for 2 hours. Controller 201 resumes the previously scheduled temperature at the next period (i.e. Day to Eve) transition. If the user also presses the Save Temperature key, then controller 201 updates the stored temperature setting for that day and time period and that zone with the modified temperature setting. In this manner, the environment of the home conforms to the lifestyle of the individual.

However, the present invention is not limited to applications in HVAC systems. For example, the present invention provides advantages in lighting systems, energy conservation systems, security systems, and home automation systems. In a lighting system shown in FIG. 16A, sensor 1602 includes a light dimmer switch and actuator 1603 includes the light dimmer and bulb. In one embodiment, the dimmer switch 1602 and dimmer/bulb 1603 are directly linked to the remote CPU 1604, i.e. the dimmer controller, by a low voltage (UL class 2 powered) line. This link provides a lower cost, safer connection than if a conventional 12 vac line were connected between the light and the switch.

In the above-described embodiment, system controller 1601 determines the level of the light desired based upon 1) a schedule, 2) user overrides of the schedule (left early & shut off light), or 3) based upon the presence of a person in a room normally unoccupied during the current point in the schedule (hallway after hours, closet any time).

Dimmer controller 1604 considers the input signal from light switch 1602 and the commands sent from the system controller 1601 via the accessory bus 1607 to determine the desired light output. Once the desired output is determined, then dimmer controller 1604 activates dimmer/bulb 1603 to meet that target. In another embodiment shown in FIG. 16B, actuator $\mathbf{1603}_1$' responds to sensor $\mathbf{1602}_1$' after 1) sensor $\mathbf{1602}_1$' sends a message to system controller 1601' via remote CPU $\mathbf{1604}_1$' and 2) actuator $\mathbf{1603}_1$' receives a message from system controller 1601' via remote CPU $\mathbf{1604}_2$'.

Traffic on accessory bus 1607 is partially eliminated by sending a ramp-up or ramp-down command followed by a stop command when the desired level is achieved. This method results in two messages from switch 1602 to system controller 1601, each message followed by a related message from system controller 1601 to dimmer controller 1604. With a slow ramp, i.e. a few second long, these four messages are sufficiently spaced, thereby reducing the bandwidth requirements to an acceptable level. Thus, if the ramp is slow enough, the user sets the desired value using an on-off-on switch. Note that leaving the switch up or down would have the net result of turning the light on or off.

Figure 17:
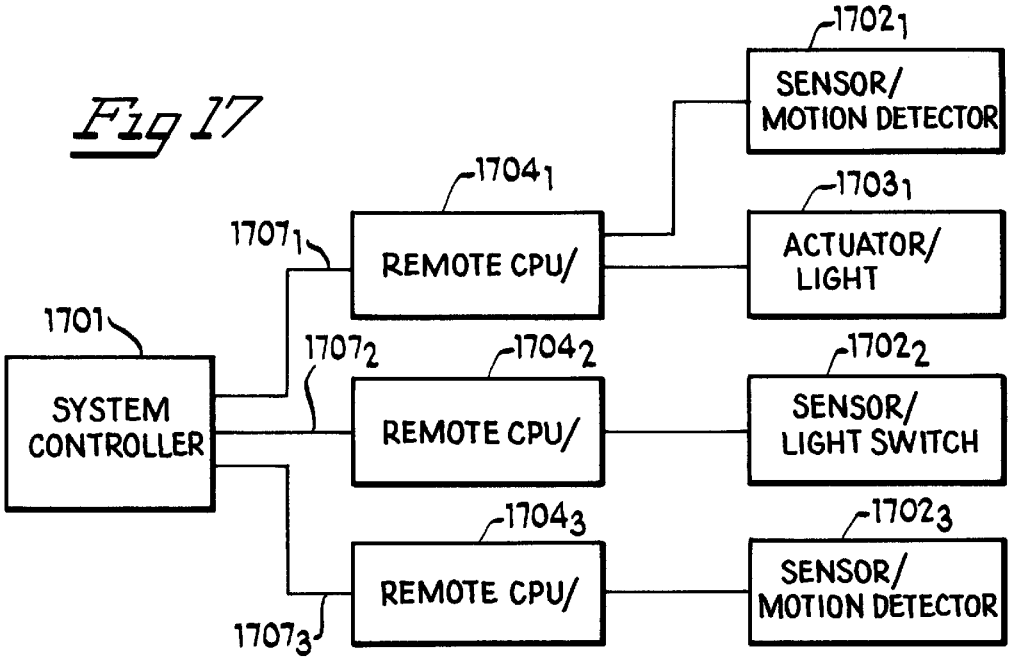
FIG. 17 illustrates another embodiment of the present invention having a sensor which includes a motion detector and an actuator which includes a light.

In accordance with the present invention, other types of sensor/actuator combinations provide the user with both convenience and security. For example, in another system 1700 shown in FIG. 17, sensor 1702 includes a motion detector and actuator 103 includes a light. Note that in this embodiment of the present invention, remote CPU $\mathbf{1704}_2$ monitors light switch $\mathbf{1702}_2$, whereas remote CPU $\mathbf{1704}_3$ monitors motion detector $\mathbf{1702}_3$. Thus, in this embodiment, only one of the two sensors is "named". For example, if light switch $\mathbf{1702}_2$ is opened by the user and motion detector $\mathbf{1702}_3$ detects the motion of the user, system controller 1701 associates the zone of light switch $\mathbf{1703}_2$ with the zone of motion detector $\mathbf{1702}_2$, thereby eliminating any operator error. Thus, the present invention associates a quantitative impact, either time of response or magnitude of response of an actuator, with a particular sensor. Activation of a light switch in a room is a clear indicator of the presence of a person. After the light has been on for a predetermined time, this indicator is no longer accurate. A motion detector provides a much more accurate indicator of the presence of a person. Therefore, in accordance with one embodiment of the present invention, after a suitable delay with no motion detected, the room lights are slowly dimmed and eventually turned off. Any motion detected in the room resets the lights to their original brightness setting for that time period.

However, a standard motion detector fires a pulse so often that following every pulse would flood the accessory bus with traffic. Therefore, in the case where motion is not a sign of illegal entry but rather an indication that a light should remain on, remote CPU 1704 counts the pulses and makes this count available to system controller 1701 upon request. System controller 1701 polls the value of this count to determine how to respond to a predetermined motion. Note that regular polling to verify that remote CPU 1704 is functional is assumed. Alternately, during periods when no pulses are expected and a quick notification of any activity is desired, remote CPU 1704 immediately sends a message (i.e alarm) to system controller 1701 when the first pulse is identified.

In yet another embodiment, remote CPU 1704 sends a message upon receiving its first pulse after five minutes of no pulses. Thus, during a typical day, the five minute timer seldom times out. Even assuming that the timer does time out and then a motion is noted, the resultant message only represents a minor interruption. At night, however, when no interruptions are expected, the 5 minutes will time out, thereby leaving remote CPU 1704 ready to instantly report the first pulse.

In system 1700, the following method is used. First, set motion detector 1702 to trigger a message on a particular condition or series of conditions, or allow the quantified conditions to be read by system controller 1701 at its convenience. Second, monitor the motion patterns in a given room, and predict required lighting conditions based on records of activity noted during prior time periods, i.e. 15 minute windows, and current motion patterns.

In accordance with the present invention, if there has been motion by the end of the time window, system controller 1701 increments the counter for this window. On the other hand, if there has been no motion, system controller 1701 decrements the same counter. The counter is limited to values between 0 and 255. Typically, the counter is started at 127 or 128 (halfway).

System controller 1701 typically divides up a day into four time periods which are set considering the patterns of motion detected. For example, Night is defined as the time period including midnight in which no motion is generally detected, and no motion is currently detected. If there is still generally substantial activity at midnight, then Night begins at the first window after midnight when no motion is generally detected and no motion is currently detected. Night ends when motion is generally detected.

Morning is defined as the time period, i.e. first hour, when motion is generally detected after Night. Morning ends earlier if motion generally stops earlier and motion is stopped.

Day or Evening (unoccupied/occupied) fills the time after Morning but before Night. During windows of no activity, the Day or unoccupied light setting is used. During windows where activity is generally noted, Evening or occupied light setting is used as the setpoint.

In one embodiment of the present invention used in a light industrial application, system controller 1701 periodically reads the data provided by the sensor, for example every 15 seconds. Each reading of the data constitutes a sample. System controller 1701 sets up a place for the samples to be written, initializes the values, then sets up a sample-to-step size conversion.

In one conversion method, if the sample is determined to be "occupied", then a positive step is made in the counter for the current window. On the other hand, if the sample is determined to be "unoccupied", then a negative step is made in the counter for the current window. In one embodiment, the positive and negative steps have different magnitudes depending on the weight of each. For example, if a 10% probability of being occupied is the threshold, then a positive step (i.e. sample "occupied") is 10× the size of a negative step (i.e. sample "unoccupied") and of the opposite polarity.

Based upon previous samples and the sample-value-to step size conversion, the current time slot is increased or decreased. If any limits, such as 0–255, have been set up, the increases or decreases are limited. Upon transitioning from one time window to another (15 minute intervals for example), system controller 1701 determines whether the area is probably going to be occupied, according to the preset test (i.e. midpoint of the counter). If system controller 1701 determines the room will probably be occupied, system controller 1701 sets the room for Occupancy lighting. If system controller 1701 determines the room will probably not be occupied, system controller 1701 sets the room for Unoccupied lighting. If the value of the counter which has been maintained is greater or less than the initial condition, the probability is with or against occupancy, respectfully, in this time period.

In one embodiment, if system 1700 is optimized for comfort, the current period and the prior period are combined to allow some margin. If it is optimized for economy, however, then only the current period result will be used.

In one embodiment of the present invention, after the Attention line has returned to its passive state, the Data line is used by any combination of remotes and controller which are enabled for audio or data communication at the same or a different rate than normal communication. Communications may consist of connecting a speaker in one room to a microphone in another room and vice versa, thereby allowing the person talking in one room to be heard in the other room. The choice of direction of the audio is determined by the first location where the controller notes a voice. If both users talk at once, one or both directions of communication are typically blocked. To minimize the impact of the ongoing bus activity needed to continue during the conversation, the audio signals are typically reconstructed, for example, in one reconstruction method the microphone is connected to an analog to digital converter. Samples are saved at a 4096 samples per second rate. The same information is grouped and sent to a digital to analog converter, then across the data line at 9600 samples per second. This method requires only 50% of the time on the bus for the audio. Thus, the overhead and any other control communication takes place in the other 50%. The length of the message is adjusted to optimize the delay of the audio (i.e. the longer the sample period the longer the delay) with the overhead and the other message length. Typically, this delay is imperceptible with the most consistent sampling and regeneration system. Even a less perfect sampling and regeneration precision produces acceptable audio for the above-described "Intercom" and "Telephone" type applications. In one embodiment, the sounds of one room, i.e. monitoring a baby, are broadcast into any predetermined number of rooms. Such a system may be configured so that the quietest signals are squelched, such as gurgling, while those above the threshold, such as crying, are reproduced.

In another embodiment, one of the microphones is replaced or supplemented by a voice recognition system, in accordance with the present invention. In this embodiment, a voice or a spaced series of sharp noises, such as three claps spaced about one second apart, opens an audio link to allow a voice recognition system in the controller to accept verbal commands.

In another embodiment, the present invention allows for the controller to accept instructions from a Utility, for example regarding energy management settings, over a modem and telephone line connection.

In another embodiment of the present invention, a transmitter is attached to a person, animal, or small child. If the transmitter is heard in a disallowed area, an alarm sounds as programmed, i.e. locally, in specific rooms, throughout the house or yard area, for example. In other embodiments, the transmitter is attached to a person to learn his/her movement patterns. For example, the transmitter indicates a desired temperature setting for each individual. A system in accordance with the present invention learns the pattern of all individuals. Thus, after a period of time, the transmitter is only necessary if a pattern changes. If no individuals are present, the controller defaults to either an energy conservation or comfort mode.

In yet another embodiment of the present invention, a cordless phone is used to talk to a CD player for help during installation or reconfiguration. For example, in this embodiment, the CD player instructs the operator to go to the kitchen and then press a key or flip a switch. Note that a compact disc used in accordance with the present invention has particular advantages. Specifically, a compact disc has a large digital storage for "data" which could be replicated and distributed for a nominal cost. Because the data may be interpreted as digital information (Numbers, Code) or may be interpreted as indexed audio, a menu system in one embodiment of the present invention is structured in which:

1) the controller moves to a particular "audio block" and reads the audio, and reads the test and branch instructions stored in the same area, and 2) then waits for a user response.

Based upon the response, the system: 1) performs a database task, a control task, or terminates the sequence; or 2) branches to a new location to continue the process started above.

In yet another embodiment of the present invention, macros are created to associate a sensor input with control point changes. In accordance with this embodiment, one light switch, for example, is programmed to change the HVAC control points, and or change the light level, and/or change the drapes, and/or notify the security system, and/or notify the audio/video system. These changes impact any number of control points. Moreover, one light switch may impact multiple lights in one group. As another example, the last light switch turned off in a home changes the security system status. This change in status prompts the controller to trigger an audio question regarding the security system status. A correct response by the user alarms/disables the system.

In yet another embodiment, audio/video setpoints are determined using inputs from remotes regarding occupant desires and from any other sensors provided by the installer. In this embodiment, the controller switches off a line socket if a room is deemed unoccupied. Similarly, the controller switches on a line socket if a room is occupied. In this manner, home appliances, such as a radio, are turned on or off depending on whether someone is present. In further accordance with the present invention, the controller identifies particular individuals using an IR, RF, or light source to communicate with a sensor in the room and conforms activation of the home appliance based on the information stored in the controller regarding previous time periods (for example, individual x listens to new wave music in the morning, but listens to classical in the evening). Conflicts between individuals are settled based upon a priority listing programmed in the system.

In yet another embodiment, energy management setpoints and optimization parameters are determined using preset schedules, inputs from remotes regarding occupant desires, inputs provided by the installer, inputs from the power meter, and inputs communicated by the utility company (or time of day use/cost rules set by the utility company). In accordance with this embodiment, the controller provides information or commands to use various appliances and energy consuming devices. These controls range from polite requests to delay or minimize consumption of power, to actual disconnection of power.

In one embodiment of the present invention, the furnace is on, and the amount of fuel and the power sent to the fan is adjusted to maintain the same temperature and static pressure in the ducts behind the damper. In order to optimize the on time of the blower, a model is developed to predict what damper setting for each room allows all rooms to reach their respective setpoints at the same time. One form of a model is: TemperatureRise=RoomLoading+Flow %*RoomRiseAt100%Flow. To determine the parameters (i.e. RoomLoading and RoomRiseAt100%Flow) a number of tests are run, and then confirmed during the normal course of maintaining the temperature setpoints. The initial parameters may be set as follows: If the damper is set for 100% flow and the temperature rises 1 tick/minute, and if flow is cut to 0% and the temperature falls at 2 ticks/minute, then the net load on the room (i.e. RoomLoading) is calculated to be −2 ticks/minute and the room temperature rise expected at 100% flow is calculated to be (RoomRiseAt100%Flow) +3 nticks/minute temperature rise. Thus, the model should predict that 67% flow generates −2+67%*3=0 tick/minutes. Subsequent similar pairs of measurements, one with the blower on and one with the blower off, are made and are averaged with the stored running average, weighing the current measurement lightly. The measurements are repeated often enough to keep up with the changes in the thermal characteristics of the rooms as the day progresses. Occasional errors in model corrections are easily tolerated because these corrections will tend to be small and are quickly corrected.

These tests each result in small changes in the model parameters which will move the model's predictions closer to the measured results. If there is an impact of two dampers on one sensor, the model takes on an additional term consisting of the product of the Flow % and the RoomRiseAt100%Flow for each added damper. To determine the parameters the controller must perform separate tests while zeroing the Flow % for all dampers except for one, then solving the linear equations. Dampers which have no overlapping impact on sensors may be tested simultaneously.

Microfiche Appendix A provides a description of the internal operation of the controller simulator for the accessory bus, a description of the software modules that drive the accessory bus in the remote and the controller, and the accessory bus specification.

Microfiche Appendix B provides a copy of the source code used in accordance with the present invention for both the remote and the controller.

Microfiche Appendix C provides a description of the remote user interface firmware.

The above description is meant to be illustrative and not limiting. Those skilled in the art will be able to devise the method and configurations within the scope of the present invention upon consideration of the detailed description and the accompanying drawings. For example, the method of communicating on the accessory bus in accordance with the present invention is readily applicable to any other physical layer, such as IR and RF. The present invention is set forth in the appended claims.

We claim:

1. A system for transmitting data between a central unit and one or more remote units, the system comprising:

one common data line operatively coupling the central unit to each of the one or more remote units;

one common attention line operatively coupling the central unit to each of the one or more remote units;

means within the central unit for placing the data on the one common data line, the data including a message having an address indicative of at least one of the one or more remote units intended to receive the data;

means within the central unit for framing the address with an attention signal placed on the one common attention line, the attention signal having a leading edge and a trailing edge;

means within each one of the one or more remote units for storing a unique identification code;

means within each one of the one or more remote units for comparing the address from the one common data line with the unique identification code within each one of the one or more remote units only when the address is framed by the attention signal; and means within each one of the one or more remote units for monitoring the one common data line for a remaining portion of the message when the address corresponds to the unique identification code within one of the one or more remote units.

2. The system according to claim 1 wherein the comparing means of at least one of the one or more remote units is configured to detect the leading edge of the attention signal on the one common attention line as an indication that the address is about to be placed by the central unit on the one common data line.

3. The system according to claim 1 wherein the address has a start bit and the comparing means of at least one of the one or more remote units is configured to detect the start bit and check the one common attention line for the attention signal as an indication that the address is being placed by the central unit on the one common data line.

4. The system according to claim 1 wherein the data include a plurality of bytes and the comparing means of at least one of the one or more remote units is configured to detect one of the plurality of bytes and check the one common attention line for the attention signal as an indication that one of the plurality of bytes currently on the one common data line is the address.

5. The system according to claim 1 wherein at least one of the one or more remote units has means for receiving and transmitting data on the one common data line and the comparing means of the at least one of the one or more remote units is configured to detect the trailing edge of the attention signal on the one common attention line as an indication that the address is contained in the receiving and transmitting data means.

6. The system according to claim 1 wherein the comparing means of a first one of the one or more remote units is configured to detect the leading edge of the attention signal on the one common attention line as an indication that the address is about to be placed by the central unit on the one common data line.

7. The system according to claim 6 wherein the address has a start bit and the comparing means of a second one of the one or more remote units is configured to detect the start bit and check the one common attention line for the attention signal as an indication that the data currently on the one common data line is the address.

8. The system according to claim 7 wherein the data include a plurality of bytes and the comparing means of a third one of the one or more remote units is configured to detect one of the plurality of bytes and check the one common attention line for the attention signal as an indication that the one of the plurality of bytes currently on the one common data line is the address.

9. The system according to claim 8 wherein a fourth one of the plurality of remote units has means for receiving and transmitting data on the one common data line and the comparing means of the fourth one of the one or more remote units is configured to detect the trailing edge of the attention signal on the one common attention line as an indication that the address is contained in the receiving and transmitting data means.

10. A method for serial communication between a central unit and one or more remote units each having a unique identification code, the method comprising the steps of:

coupling the central unit to each of the one or more remote units with one common data line and one common attention line;

transmitting information from the central unit on the one common data line having an address and a remaining message;

framing the address with an attention signal on the one common attention line generated by the central unit;

comparing the address in each of the one or more remote units only if the attention signal is framing the address; and processing the remaining message in a desired remote unit of the one or more remote units in which the unique identification code matched the transmitted address.

11. The method according to claim 10 wherein the step of transmitting information on the one common data line comprises the sub-steps of:

transmitting first a start bit;

transmitting second a byte of the information; and then transmitting a plurality of stop bits while the central unit prepares a next segment of the information to be transmitted.

12. The method according to claim 11 wherein the plurality of stop bits is 9 and 80 bits whereby ensuring under half utilization of the one common data line thus allowing the one or more remote units an opportunity to processes the bits during the one or more stop bits.

13. The method according to claim 11 wherein the step of processing the remaining message further includes the sub-steps of:

locating the plurality of stop bits in an expected location; and accepting the transmitted byte of information only if the plurality of stop bits are located in the expected location.

14. The method according to claim 13 further comprising the step of an interrupting remote unit from one of the one or more remote units obtaining immediate attention of the central unit including the sub-step of:

causing the desired remote unit to fail to locate the plurality of stop bits in the expected location by the interrupting remote unit transmitting an interrupt signal of opposite polarity to the plurality of stop bits for sufficient time to ensure overlap with the expected location of the plurality of stop bits.

15. The method according to claim 14 further comprising the steps of stopping the interrupt signal and looking on the one common data line for the interrupt signal to determine whether another one of the one or more remote units is also attempting to interrupt a current message.

16. The method according to claim 10 wherein the remaining message from the central unit on the one common data line includes a command for the desired remote unit to perform some function, the method further including the step of waiting to contact the desired remote unit during its performance of the command.

17. The method according to claim 16 further including the step of the desired remote unit ignoring the data on the one common data line during its performance of the command.

18. The method according to claim 10 wherein the information includes the address having one-byte length and a remaining message each portion of which having a one-byte length, said remaining message including at least a one-byte command field, a one-byte length field, and a one-byte error-checking field, the method further comprises the steps of:

splitting in the central unit each byte into nibbles in order of transmission on the one common data line;

calculating in the central unit a Fletcher checksum from the nibbles, least significant and then most significant nibble in order of transmission on the one common data line;

complementing in the central unit the Fletcher checksum, wherein the complemented Fletcher checksum comprises the one-byte error-checking field;

splitting in the desired remote unit each byte into nibbles in order of receipt on the one common data line;

calculating in the desired remote unit the Fletcher checksum from the nibbles, least significant and then most significant nibble in order of transmission on the one common data line including the one-byte error-checking field;

accepting the information in the desired remote unit only if the Fletcher checksum calculated therein is zero.

19. The method according to claim 10 further comprising the steps of:

transmitting information from the desired remote unit only if the Fletcher checksum calculated therein is zero, the information including at least a one-byte command field, a one-byte length field, and a one-byte error-checking field;

splitting in the desired remote unit each byte as well as the unique identification code into nibbles the unique identification code first and then each byte in order of transmission onto the one common data line;

calculating in the desired remote unit a Fletcher checksum from the nibbles least significant nibble and then most significant nibble in order of transmission on the one common data line;

complementing in the desired remote unit the Fletcher checksum, wherein the complemented Fletcher checksum comprises the one-byte error-checking field;

splitting in the central unit the address as well as each byte into nibbles the address first and then each byte in order of reception on the one common data line;

calculating in the central unit the Fletcher checksum from the nibbles least significant and then most significant nibble in order of transmission on the one common data line; and accepting the information in the central unit only if the modified Fletcher checksum calculated therein is zero.

20. A method for error-checking in a system having a central unit and one or more remote units, the central unit and one or more remote units being connected by one common data line, the method comprising the steps of:

transmitting information from the central unit on the one common data line, the information including at least a one-byte address, a one-byte command field, a one-byte length field, and a one-byte error-checking field;

splitting in the central unit each byte into nibbles in order of transmission on the one common data line;

calculating in the central unit a Fletcher checksum from the nibbles, least significant and then most significant nibble in order of transmission on the one common data line;

complementing in the central unit the Fletcher checksum, wherein the complemented Fletcher checksum comprises the one-byte error-checking field;

splitting, in a desired remote unit of the one or more remote units in which the unique identification code matched, each byte into nibbles in order of receipt on the one common data line;

calculating in the desired remote unit the Fletcher checksum from the nibbles, least significant and then most significant nibble in order of transmission on the one common data line including the one-byte error-checking field;

responding to the command in the desired remote unit only if the Fletcher checksum calculated therein is zero;

transmitting return information from the desired remote unit only if the Fletcher checksum calculated therein is zero, the return information including at least a one-byte command field, a one-byte length field, and a one-byte error-checking field;

splitting in the desired remote unit the unique identification code as well as each byte into nibbles the unique identification code first and then each byte in order of transmission onto the one common data line;

calculating in the desired remote unit a Fletcher checksum from the nibbles least significant nibble and then most significant nibble;

complementing in the desired remote unit the Fletcher checksum, wherein the complemented Fletcher checksum comprises the one-byte error-checking field;

receiving in the central unit the return information from the desired remote unit on the one common data line;

splitting in the central unit the address as well as each byte of the return information into nibbles the address first and then each byte in order of reception on the one common data line;

calculating in the central unit the Fletcher checksum from the nibbles least significant nibble and then most significant nibble in order; and accepting the information in the central unit only if the modified Fletcher checksum calculated therein is zero.

21. A remote unit for communicating with a central unit over one data line and one attention line each line being operatively coupled between the remote and central units, the one data line transmitting information including at least an address and a command, the attention line transmitting an attention signal which frames the address on the one data line, the remote unit comprising:

means for storing a unique identification code;

means for comparing the address from the one data line with the unique identification code only when the address is framed by the attention signal; and means for responding on the one data line to the command with return information if the address corresponds to the unique identification code, the responding means including means for calculating an error-check field based on the return information and unique identification code even though the unique identification code is not transmitted back to the central unit.

* * * * *

UNITED STATES PATENT AND TRADEMARK OFFICE

CERTIFICATE OF CORRECTION

PATENT NO. : 6,108,614
DATED : August 22, 2000
INVENTOR(S) : Lincoln et al.

It is certified that error appears in the above-identified patent and that said Letters Patent is hereby corrected as shown below:

Column 6,
Line 50, after "254", delete "n"

Column 10,
Line 9, after "period (i.e.,", insert -- morning, day, evening or night) and views and/or sets its --

Column 14,
Line 6, after "diode pair", delete "721" and insert -- 720 --
Line 40, delete "484" and insert -- 489 --

Column 15,
Line 9, delete "IT" and insert -- T --
Line 59, after "duct." insert new paragraph -- Rearranging terms yields: --

Column 17,
Line 48, delete "note" and insert -- node --

Column 18,
Line 22, delete "12 vac" and insert -- 120 vac --

Column 22,
Line 41, delete "nticks/minute" and insert -- ticks/minute --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*